US007779493B2

(12) United States Patent
Lemire et al.

(10) Patent No.: US 7,779,493 B2
(45) Date of Patent: Aug. 24, 2010

(54) ERGONOMIC CONTROL APPARATUS FOR A PATIENT SUPPORT APPARATUS

(75) Inventors: Guy Lemire, Beaumont (CA); Jean-Paul Dionne, Lévis (CA); Marco Morin, Lévis (CA); David Kim Soui Wan Fong, St-Romuald (CA); Nicolas Cantin, St-Nicolas (CA)

(73) Assignee: Stryker Corporation, Kalamazoo, MI (US)

( * ) Notice: Subject to any disclaimer, the term of this patent is extended or adjusted under 35 U.S.C. 154(b) by 654 days.

(21) Appl. No.: 11/588,726

(22) Filed: Oct. 27, 2006

(65) Prior Publication Data

US 2007/0130692 A1 Jun. 14, 2007

Related U.S. Application Data

(60) Provisional application No. 60/730,787, filed on Oct. 27, 2005.

(51) Int. Cl.
*A61G 7/015* (2006.01)
*A61G 7/018* (2006.01)
*G08B 1/08* (2006.01)

(52) U.S. Cl. ..... 5/600; 5/616; 5/617; 5/618; 340/573.1

(58) Field of Classification Search ..... 5/618, 5/617, 616, 600, 503.1, 658; 340/573.1, 340/825.19
See application file for complete search history.

(56) References Cited

U.S. PATENT DOCUMENTS 5,425,148 A * 6/1995 Ashcraft et al. ..... 5/507.1
5,542,136 A 8/1996 Tappel
5,542,138 A * 8/1996 Williams et al. ..... 5/658
5,592,153 A * 1/1997 Welling et al. ..... 340/825.19
5,715,548 A * 2/1998 Weismiller et al. ..... 5/624
6,131,868 A * 10/2000 Welling et al. ..... 248/276.1
6,208,250 B1 * 3/2001 Dixon et al. ..... 340/573.1
6,289,537 B1 9/2001 Hopper et al.
6,320,510 B2 * 11/2001 Menkedick et al. ..... 340/573.1
6,481,688 B1 * 11/2002 Welling et al. ..... 248/694
6,486,792 B1 * 11/2002 Moster et al. ..... 340/825.19
6,560,798 B2 * 5/2003 Welling et al. ..... 5/503.1
6,611,979 B2 * 9/2003 Welling et al. ..... 5/624
6,658,680 B2 * 12/2003 Osborne et al. ..... 5/600
6,680,443 B2 * 1/2004 Dixon ..... 177/144
6,691,346 B2 * 2/2004 Osborne et al. ..... 5/600
6,704,956 B2 * 3/2004 Riley et al. ..... 5/600
6,761,344 B2 * 7/2004 Welling et al. ..... 248/694
6,781,517 B2 * 8/2004 Moster et al. ..... 340/825.19
6,791,460 B2 * 9/2004 Dixon et al. ..... 340/573.1

(Continued)

*Primary Examiner*—Robert G Santos
(74) *Attorney, Agent, or Firm*—Van Dyke, Gardner, Linn & Burkhart, LLP

(57) ABSTRACT

The present invention provides a control apparatus that can be ergonomically and movably connected to a patient support apparatus. The control apparatus comprises a control module which is operatively coupled to the patient support apparatus and can provide a means for controlling the plurality of patient support apparatus functions. The control module is adapted for connection to a housing and the housing is movably connected to the patient support apparatus by a coupling device. The coupling device enables the relative movement of the housing and as such the control module relative to the patient support apparatus. In this manner access to the control module, and therefore to the functionality of the patient support apparatus, can be provided independent of the configuration of the patient support apparatus.

18 Claims, 31 Drawing Sheets

U.S. PATENT DOCUMENTS 6,829,796 B2 * 12/2004 Salvatini et al. ..... 5/713
6,880,189 B2 * 4/2005 Welling et al. ..... 5/624
6,924,441 B1 * 8/2005 Mobley et al. ..... 177/144
6,957,461 B2 * 10/2005 Osborne et al. ..... 5/618
6,978,500 B2 * 12/2005 Osborne et al. ..... 5/600
7,007,765 B2 3/2006 Waters et al.
7,008,269 B2 * 3/2006 Riley et al. ..... 439/668
7,032,522 B2 * 4/2006 George et al. ..... 108/50.01
7,171,708 B2 * 2/2007 Osborne et al. ..... 5/618
7,310,839 B2 * 12/2007 Salvatini et al. ..... 5/280
7,314,010 B2 * 1/2008 George et al. ..... 108/50.01
7,454,805 B2 * 11/2008 Osborne et al. ..... 5/618
7,472,439 B2 * 1/2009 Lemire et al. ..... 5/607
7,540,243 B2 * 6/2009 George et al. ..... 108/50.01
7,679,520 B2 * 3/2010 Zerhusen et al. ..... 340/573.1
2001/0032362 A1 * 10/2001 Welling et al. ..... 5/600
2002/0002742 A1 * 1/2002 Osborne et al. ..... 5/600
2002/0066142 A1 * 6/2002 Osborne et al. ..... 5/600
2002/0080037 A1 * 6/2002 Dixon et al. ..... 340/573.1
2003/0019038 A1 * 1/2003 Welling et al. ..... 5/503.1
2003/0052787 A1 * 3/2003 Zerhusen et al. ..... 340/573.1
2003/0076238 A1 * 4/2003 Moster et al. ..... 340/825.19
2003/0112147 A1 * 6/2003 George et al. ..... 340/691.6
2004/0034936 A1 * 2/2004 Welling et al. ..... 5/624
2004/0128765 A1 * 7/2004 Osborne et al. ..... 5/600
2004/0177445 A1 * 9/2004 Osborne et al. ..... 5/600
2006/0075560 A1 * 4/2006 Osborne et al. ..... 5/618
2006/0096029 A1 * 5/2006 Osborne et al. ..... 5/618
2006/0117482 A1 * 6/2006 Branson ..... 5/600
2006/0180054 A1 * 8/2006 George et al. ..... 108/50.11
2006/0272097 A1 12/2006 Dionne et al.
2006/0277683 A1 * 12/2006 Lamire et al. ..... 5/600
2006/0279427 A1 * 12/2006 Becker et al. ..... 340/573.4
2007/0130692 A1 * 6/2007 Lemire et al. ..... 5/618
2007/0157385 A1 * 7/2007 Lemire et al. ..... 5/600
2007/0163043 A1 * 7/2007 Lemire et al. ..... 5/600
2007/0163045 A1 7/2007 Becker et al.
2007/0164871 A1 * 7/2007 Dionne et al. ..... 340/573.1
2007/0169268 A1 * 7/2007 Lemire et al. ..... 5/617
2007/0174964 A1 * 8/2007 Lemire et al. ..... 5/600
2007/0174965 A1 * 8/2007 Lemire et al. ..... 5/600
2008/0087202 A1 * 4/2008 George et al. ..... 108/50.01
2008/0172789 A1 * 7/2008 Elliot et al. ..... 5/616
2009/0031498 A1 * 2/2009 Girard et al. ..... 5/617

* cited by examiner

172

174

ERGONOMIC CONTROL APPARATUS FOR A PATIENT SUPPORT APPARATUS

FIELD OF THE INVENTION

The present invention pertains to the field of patient support apparatuses. More particularly, the present invention relates to a control apparatus for use with patient support apparatus.

BACKGROUND

Medical and hospital beds for patient support are known in the art. Typically, such patient support apparatuses are used to provide a support surface for treatment, recuperation or rest of patients. Many such patient support apparatuses include a frame, a support surface held by the frame, a mattress, siderails configured to block egress of a patient from the mattress, and a controller configured to control one or more features of the bed.

In order to accommodate various needs and treatments, medical and hospital beds are required to be versatile and must be articulated as much as possible. Traditionally, when a bed is positioned or articulated to meet a specific treatment or patient need, access to the controller of the bed can be an issue. Often, access to the controller is encumbered by other parts of the bed, and can often only be achieved with difficulty due to the relative position of the health care provider, and therefore clear vision of the controls or status of bed functions by the health care provider can be compromised.

The frame of a medical bed can have various positions such as lowered near to the floor to assist the patient in exiting the bed, raised, in a chair position with the contraction of some of its components or various other configurations, depending on the specifications of the bed frame. In one example, one lift mechanism may tilt a back section so that the patient's back and head may be raised, while another lift mechanism may adjust a knee section of the mattress support to raise the patient's knees. Furthermore, in many adjustable hospital beds, the entire mattress supporting structure may be tilted or canted to either the Trendelenburg position (head down, feet up) or to the reverse Trendelenburg position (head up, feet down). The bed is typically adjusted to the Trendelenburg position when the patient goes into shock, whereas the reverse Trendelenburg position is employed for drainage. In order to perform all these and other movements, a control module which can be accessed by the patient or a third party is required. There are several advantages in having this control module visible and accessible at all times for the intended operator. It should also be attached to the bed to avoid being misplaced. As the bed can be moved, the control module must travel with the bed. An ideal location for the control module is at the foot end of the bed since it is often situated closer to the door of the room. The health care provider also often stands at the foot end of the bed to communicate with the patient. The foot end of the bed is also a good location for the control module in cases where the patient suffers from a highly contagious ailment or is vulnerable to infections because the direct proximal interactions between the patient and others are limited. This allows the health care provider to adjust or change the position of the patient, verify the status of the bed or patient, all while being able to communicate with the patient. In conventional known medical bed designs, where the foot section of the bed must be lowered, the health care provider might lose sight of the control module and see his/her accessibility thereto reduced because of the angle and relative position of the foot section. In such a case, it is also possible that the health care provider may not be able to use or control some or all the functions of the bed when the control module is situated too close to the floor or in a position in which it is ergonomically difficult to properly operate.

For example, published U.S. patent application Ser. No. 10/731,720 (Publication No. 2004/0177445), now U.S. Pat. No. 6,957,461, discloses a hospital bed which includes a frame, a deck including a seat section and a foot section movable relative to the seat section. The disclosed bed further includes a mechanism that controls movement of the foot section relative to the seat section. The bed includes a footboard or second barrier comprising a modular control unit for controlling the automated features of a hospital bed and a base. The modular control unit includes a support panel slidably coupled to the base. The modular control unit has a control panel pivotably coupled to the support panel which is rotatable between two positions, a use position and a storage position. The disclosed control panel has a series of buttons for controlling some functions of a hospital bed. The disclosed bed requires a support panel attached to the base of the bed by a sliding movement, limiting the types of beds it can be attached to. The modular control unit in the disclosure is also only pivotally adjustable to two positions, a use position and a storage position, and is not always readily accessible or visible since its position is interdependent on the position of the base of the footboard or the second barrier. This disclosed modular control unit is primarily designed to be operated by the patient.

U.S. patent application Ser. No. 11/040,272 (Publication No. 2005/0188462), now U.S. Pat. No. 7,200,882, discloses a controller embedded in a siderail of a medical bed, or in a means mounted to the bed for inhibiting egress from the bed, but with the limitation that the inhibiting means being movable between a raised position and a lowered position. This application is limited to a controller which is pivotally connected to the siderail (or "inhibiting means")and is able to pivot around a single axis. Also, the disclosed controller only has two stationary positions: the stored position and the deployed position, often resulting in a poor ergonomic position for operation of the controller. In addition, the controller changes position when the structure to which it is attached is moved, therefore diminishing the accessibility and visibility of the control module.

Therefore there is a need for a new ergonomic control apparatus for use with a patient support apparatus which overcomes the disadvantages identified in the prior art.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

An object of the present invention is to provide an ergonomic control apparatus for a patient support apparatus. In accordance with an aspect of the present invention, there is provided control apparatus for use with a patient support apparatus, said control apparatus comprising: a housing; a control module adapted for connection to the housing, said control module operatively coupled to the patient support apparatus and configured for controlling one or more functions associated with the patient support apparatus; and a coupling device movably connecting the housing to the patient support apparatus, said coupling device providing movement of the housing in one or more dimensions relative to the patient support apparatus; wherein the control apparatus can be positioned in order that a user interface associated therewith is accessible to an operator independent of configuration of the patient support apparatus.

DETAILED DESCRIPTION OF THE INVENTION

Definitions

Figure 1:
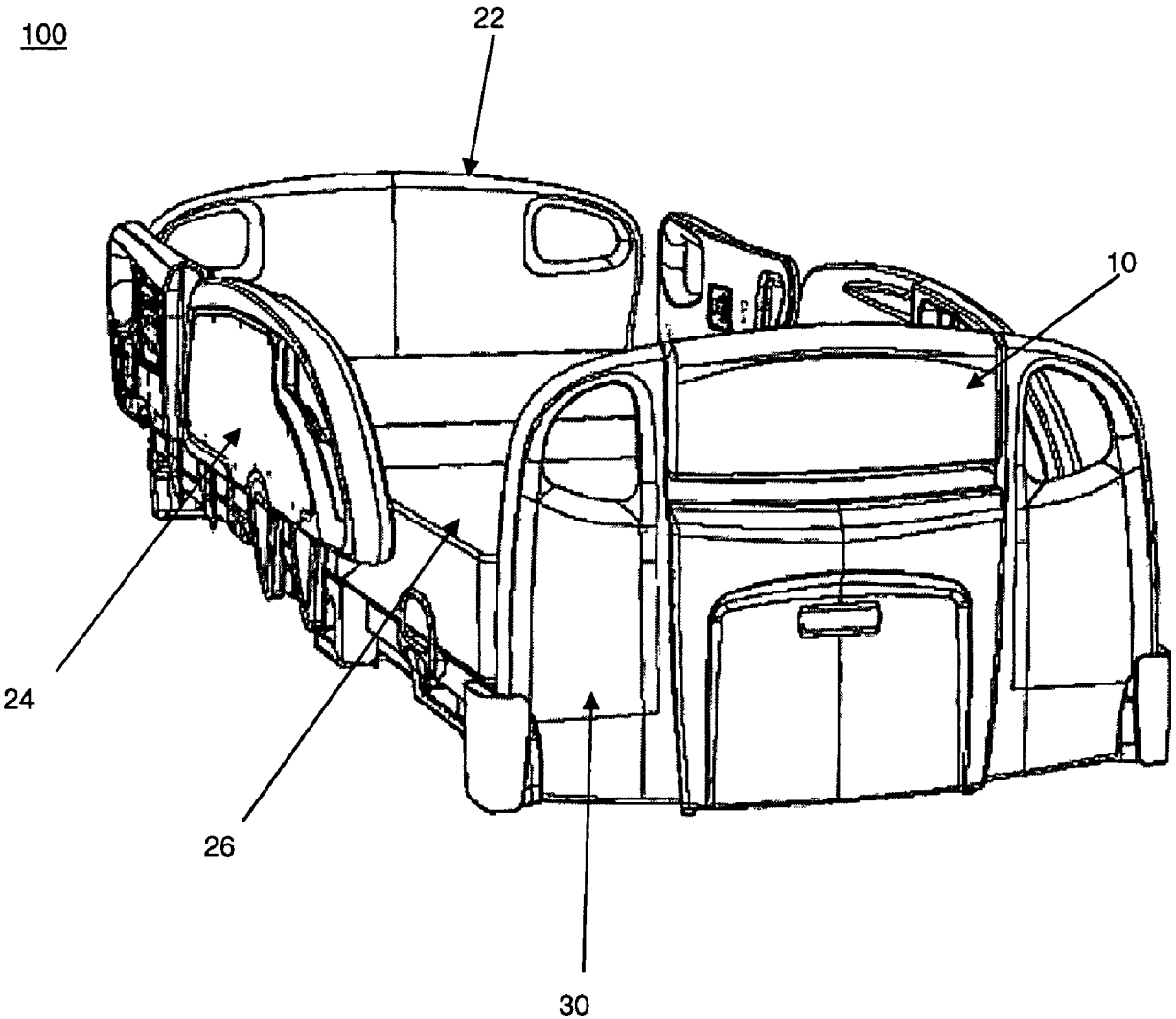
FIG. 1 is a perspective view of a patient support apparatus with a control apparatus according to one embodiment of the present invention, wherein the control apparatus is in a stowed position.

As used herein, the term "about" refers to a +/−10% variation from the nominal value. It is to be understood that such a variation is always included in any given value provided herein, whether or not it is specifically referred to.

Unless defined otherwise, all technical and scientific terms used herein have the same meaning as commonly understood by one of ordinary skill in the art to which this invention belongs.

The present invention will thus be described in association with a patient support apparatus that includes a frame system and a mattress or other lying surface. The frame system includes a base frame supported on the floor, for example by a plurality of caster wheels, an intermediate frame supported by an elevation system comprising lift arms configured to raise and lower the intermediate frame relative to the base frame, and a deck support connected to the intermediate frame. The deck support comprising a head or fowler section, a seat section and a foot section, each configured to tilt or rotate relative to the intermediate frame between a plurality of positions. It would be readily understood by a worker skilled in the art that a patient support apparatus can be configured in other ways. The control apparatus according to the present invention would be readily usable with alternate configurations of a patient support apparatus as would be readily understood by a worker skilled in the art.

The control apparatus according to the present invention can be movably connected to a plurality of different patient support apparatuses, wherein the control module associated with the control apparatus provides a means for controlling the functionality of the patient support apparatus. For example, a patient support apparatus that can be associated with the control apparatus according to the present invention may comprise a plurality of adjustable sectional components, namely an adjustable foot section, head section and seat section which can enable the lying surface of the patient support apparatus to be adjusted into a variety of positions as desired or needed. The patient support apparatus can comprise a global elevation mechanism in addition to drive and braking systems. The operation of some or all of these functional components of the patient support apparatus can be controlled by the control module.

The present invention provides a control apparatus that can be ergonomically and movably connected to a patient support apparatus. The control apparatus comprises a control module which is operatively coupled to the patient support apparatus and can provide a means for controlling the plurality of patient support apparatus functions. The control module is adapted for connection to a housing and the housing is movably connected to the patient support apparatus by a coupling device. The coupling device enables the relative movement of the housing and as such the control module relative to the patient support apparatus. In this manner access to the control module, and therefore to the functionality of the patient support apparatus, can be provided independent of the configuration of the patient support apparatus.

Figure 2:
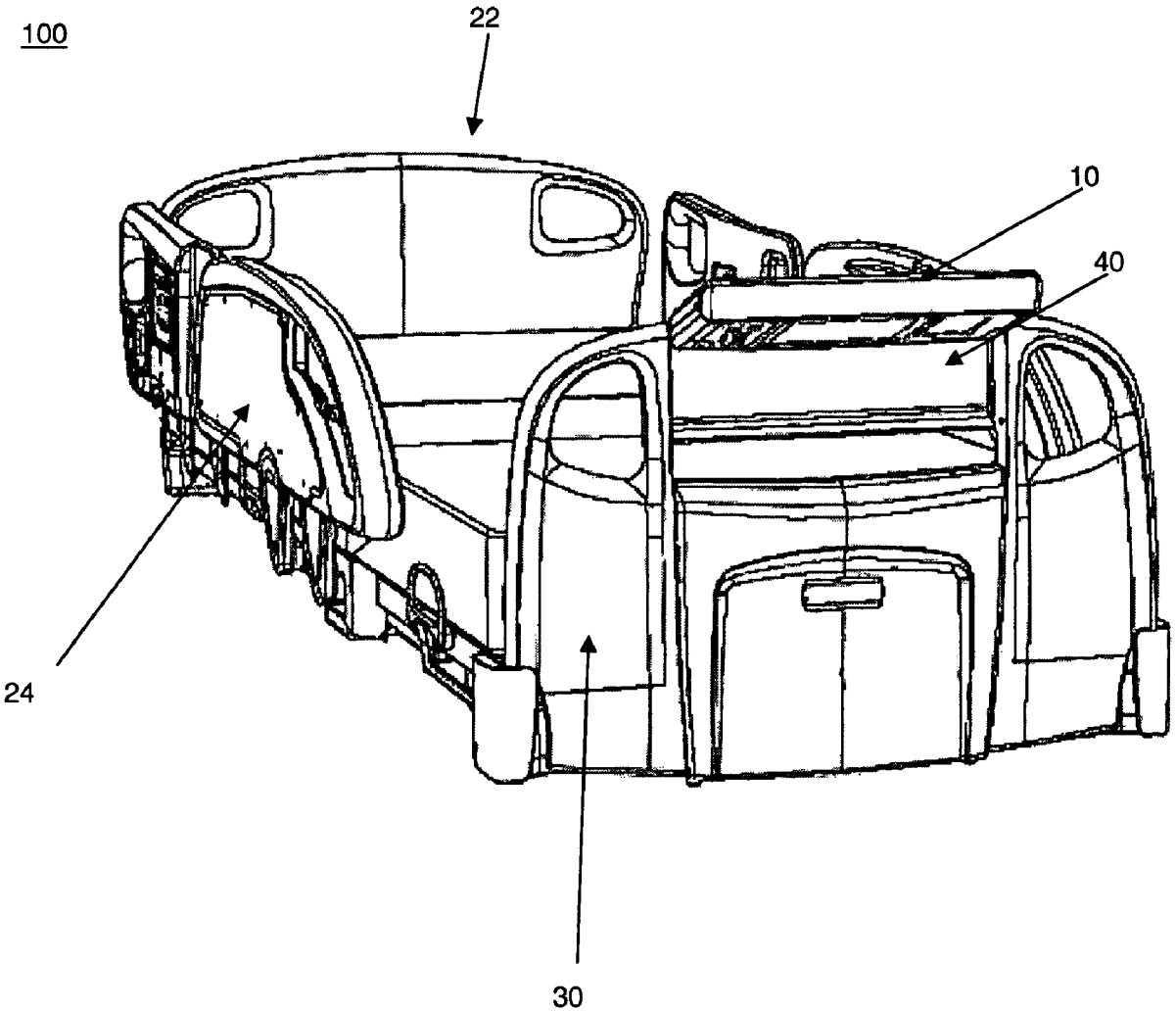
FIG. 2 is a perspective view of a patient support apparatus with the control apparatus of FIG. 1, wherein the orientation of the control apparatus in between a stowed position and an operational position.
Figure 3:
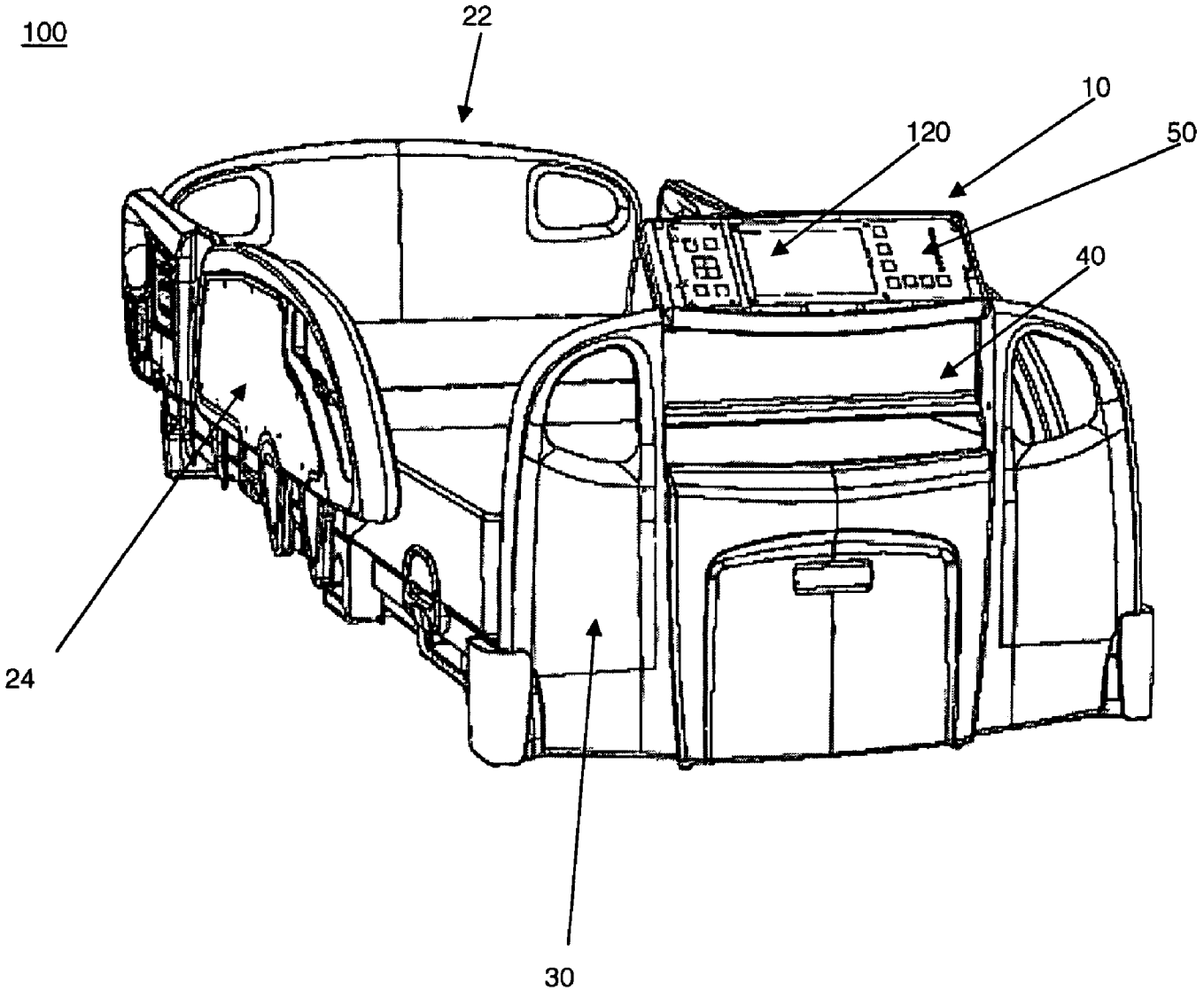
FIG. 3 is a perspective view of a patient support apparatus with the control apparatus of FIG. 1, wherein the control apparatus is in an operational position.

With reference to FIGS. 1 to 3, a control apparatus according to one embodiment of the present invention is illustrated and associated with a patient support apparatus. The patient support apparatus comprises a foot panel 30, head panel 12 and multiple siderails 14, which substantially define a perimeter of the lying surface 16 of the patient support apparatus 100. In this embodiment, the control apparatus 10 is located at the foot end of the patient support apparatus 100, and is operatively coupled to the foot panel 30. The control apparatus 10 is rotatably connected to the patient support apparatus by a coupling device which is configured in order to allow the control apparatus to rotate on at least one axis between angles ranging from about 0 degrees to about 360 degrees. In the embodiment illustrated in FIGS. 1 to 3, a rotational axis is illustrated as being substantially horizontal and perpendicular to the length of the patient support apparatus 100.

In one embodiment, in the stored position, as shown in FIG. 1, the back side of the control apparatus 10 is facing the exterior of the patient support apparatus 100. The user interface of the control apparatus 10 is therefore hidden and facing the back panel 40 of an embedding cavity in the foot panel when in the stored position. With reference to FIGS. 2 and 3, the back panel is visible, as the control apparatus is positioned between a stored and an operative position in FIG. 2, and positioned in an operative position in FIG. 3. Provision of the back panel 40 can provide protection to the control apparatus, and prevent inadvertent or accidental entries and modifications via the control apparatus 10 when the control apparatus is in the stored position. In addition, the control apparatus 10 is protected by the foot panel 20 when it is stored and thus damage occurring during transport of the patient support apparatus can be reduced.

When the control apparatus is in an operational position, as depicted in FIG. 3, the user interface 50 is exposed, allowing a user to operate the control apparatus 10. The control apparatus 10 can have a handle region (not shown) which can provide ease of manipulation of the control apparatus from a stored position as shown in FIG. 1, through a transitional position as shown in FIG. 2, to an operational position as shown in FIG. 3, and vice-versa. The user interface 50 has several control features to enable the user to effectively control various functions of the patient support apparatus 100 via the control apparatus. The control apparatus can also have a screen 120 associated therewith to display the status of the patient support apparatus 100, status of the patient or other information as may be required.

Housing

The housing of the control apparatus is configured to physically house the control module and its sub-components. The housing can be configured to provide one or both impact protection and chemical or fluid protection to the control module therein, while providing a user access the functionality of the control module through a user interface associated with one or more surfaces of the housing. For example, as illustrated in FIG. 3, an entire surface of the control apparatus has a user interface associated therewith, which comprises a plurality of access buttons and/or visual screens.

The shape and construction of the housing is not restricted to a particular design but can rather be dependent on the attachment location between the patient support apparatus and the housing and can be further based on the format of the coupling device used to movably connect the housing to the patient support apparatus. For example, the shape of a housing can differ depending on if it is to be coupled to the foot board, head board or siderail of a patient support apparatus. In addition, the shape can be dependent on the format and physical aesthetics of the patient support apparatus to which it is to be coupled. As such, variations in the shape and construction of the housing which serve the functionality described herein are purely design choices of an element of the present invention.

The housing is configured in a manner and constructed from one or more different materials, in order that a desired coupling device can be connected to the housing, while providing a desired level of fatigue resistance for this connection to use and movement of the housing relative to the patient support apparatus. The configuration of the housing can be dependent on the type and configuration of the coupling device to which it is to be connected. For example, the design of a housing having one connection point to a coupling device will be design in a different manner to a housing which has two connection points to a coupling device, as added stresses may be induced in a single connection location.

The housing of the control apparatus can be fabricated from one or more of a plurality of materials including plastic, polymer, metal, alloys or the like or other material as would be readily understood by a worker skilled in the art. The selection of the material can be based on, for example, desired strength, impact resistance, resistance to cleaning fluids, manufacturing costs and the like. In one embodiment of the present invention, the housing is manufactured from a plastic or polymer and can be manufactured using for example blow moulding or injection moulding or other method as would be readily understood by a worker skilled in the art.

In one embodiment of the present invention, the housing is formed from multiple materials. In one embodiment of the present invention, the housing comprises an interior frame system formed from aluminium, an alloy or other material which has for example a desired strength, a desired density and/or a desired corrosion resistance. The interior frame system can provide the structural integrity to the housing. The interior frame system can be enclosed using a cover, for example manufactured from a plastic or polymer, which can provide a barrier to penetration of a plurality of fluids, bacteria or the like.

The housing can be manufactured from multiple parts which are assembled to form the completed housing. For example, the housing can be formed from two parts which are coupled together upon insertion of all required components therein, for example the control module. One or more sealing means, for example sealing rings, gaskets or other similar sealing means can be provided at the mating joints of the two part housing enabling a seal to be formed there between, thereby providing a desired protection to the components, for example the control module, within the housing.

In one embodiment of the invention, a protective flexible membrane is coupled to the housing at the location of a user interface, wherein this membrane can be permanently or removably coupled to the housing. This membrane can provide a means for sealing one or more interfaces between components of the housing which will be located under the membrane upon attachment to the housing. The protective flexible membrane can comprise a plurality of indicators, for example button definitions or other indicators thereon which can provide a user with queues for the operation of the functionality of the control apparatus. The flexibility of the membrane can enable a user to push thereon and activate a button or switch associated with the control apparatus which is positioned there below. In addition, for example, the protective flexible membrane can comprise one or more clear windows to enable a user to see any information that may be displayed on a screen associated with the control apparatus. In one embodiment of the present invention, the protective flexible membrane can be permanently adhered to the housing by an adhesive. In another embodiment of the present invention, the protective flexible membrane can be magnetic and the housing can comprise one or more magnetic regions, which can provide a means for removably connecting the flexible protective membrane to the housing.

Coupling Device

The coupling device of the control apparatus provides a connection between the housing and the patient support apparatus. The coupling device can be configured in a plurality of different configurations which can enable the housing to move in one or more dimensions relative to the patient support apparatus. The coupling apparatus can be configured to provide one or both of rotational movement and translational movement of the housing relative to the patient support apparatus. The coupling apparatus can be configured to provide rotational movement about one or multiple axes and/or translational movement in one or multiple directions.

The coupling device can be configured as for example, a ball and socket-type connection, a rotational joint connection, multiple rotational joint connection, a slot and pin connection, key and keyway connection or other connection configurations enabling relative movement between the housing and the patient support apparatus as would be readily understood by a worker skilled in the art.

For example, a ball and socket-type connection can be configured to provide two dimensional or three dimensional movement. A single or multiple rotational joint connection can be configured to provide rotation about one, two, three or more axes. A slot and pin connection can be configured to provide linear or curvilinear translation and/or rotation and the provision of multiple interconnected slots may provide for a range of relative orientations between the control apparatus and the patient support apparatus. A key and keyway connection can provide linear or curvilinear translation while potentially limiting relative rotation between the control apparatus and the patient support apparatus. As would be readily understood by a worker skilled in the art, there are a plurality of other connection types that may provide a desired relative movement between the control apparatus and the patient support apparatus and are considered to be within the scope of the present invention.

In one embodiment of the present invention, the coupling device is configured such that all the wires and/or electrical connections which are required to establish a power and/or data connection between the control module and the patient support apparatus are designed to pass through the coupling device. Accordingly, all of the wires and/or electrical connection are located within an internal region of the coupling device and not visible from the exterior thereof, thereby substantially eliminating the risk of entanglement between the wires and other parts of the control apparatus or the patient support apparatus. This configuration of the coupling device can substantially eliminate encumbrances from external wires for the health care provider to attend to the patient properly and efficiently.

In another embodiment of the present invention, proximate relative movable parts of the coupling device are configured to enable power and/or data connection between the control module and the patient support apparatus during relative movement therebetween. In this embodiment, electrical coupling between the proximate relative movable parts can be provided by one or more electrically conductive pins formed on a first of the proximate parts, wherein these pins are capable of electrically connecting with one or more electrically conductive grooves formed on a second proximate part. During relative movement of the first and second proximate parts, the established electrical connection is maintained thereby providing power and/or data transfer independent of the position and or movement of the control apparatus relative to the patient support apparatus.

In one embodiment of the present invention, the coupling device comprises a damping mechanism that can provide a means for controlling the speed of relative movement between the control apparatus and the patient support apparatus. The damping mechanism can be configured as one or a combination of mechanical, electrical, hydraulic and magnetic damping systems. In one embodiment of the present invention, the damping mechanism can be damping grease, friction discs, springs, elastomerics or other damping mechanism as would be readily understood by a worker skilled in the art. The selection and configuration of a damping mechanism for association with a particular coupling device, can be determined based on the type of relative movement between the control apparatus and the patient support apparatus.

Rotational Joint Connection

In one embodiment of the present invention, and as illustrated in FIGS. 1 to 3, the control apparatus 10 is operatively coupled to the foot panel 30 of a patient support apparatus 100. The coupling device can be designed as a rotational joint connection (not shown) which is configured to enable substantially about 360 degree rotation. In this configuration, the user interface 50 associated with the control apparatus 10 can be facing the back panel 40 of the foot panel 30, when in a stored configuration thereby providing protection thereto.

Figure 4:
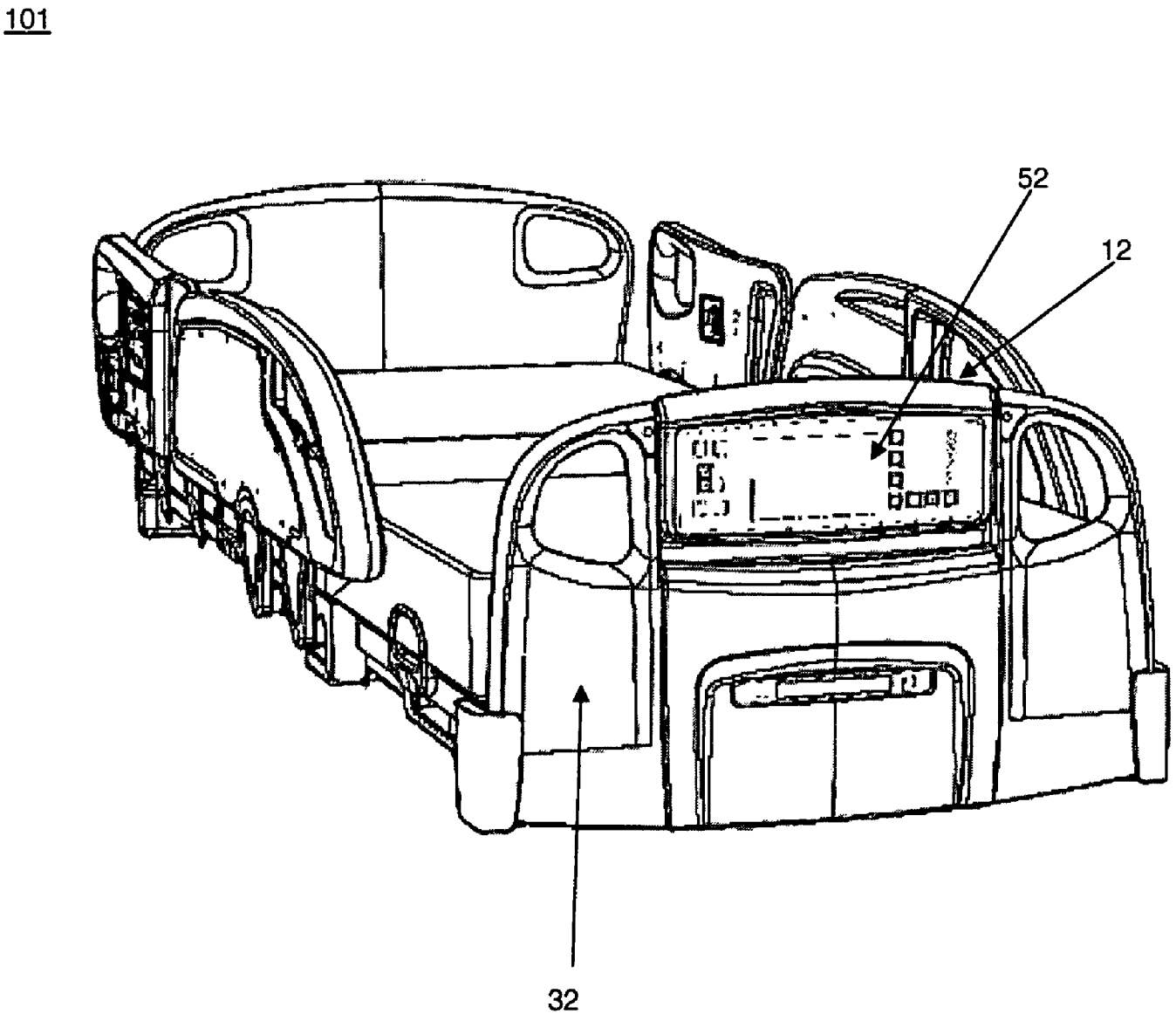
FIG. 4 is a perspective view of a patient support apparatus with a control apparatus according to one embodiment of the present invention, wherein the control apparatus is in a stowed position.
Figure 5:
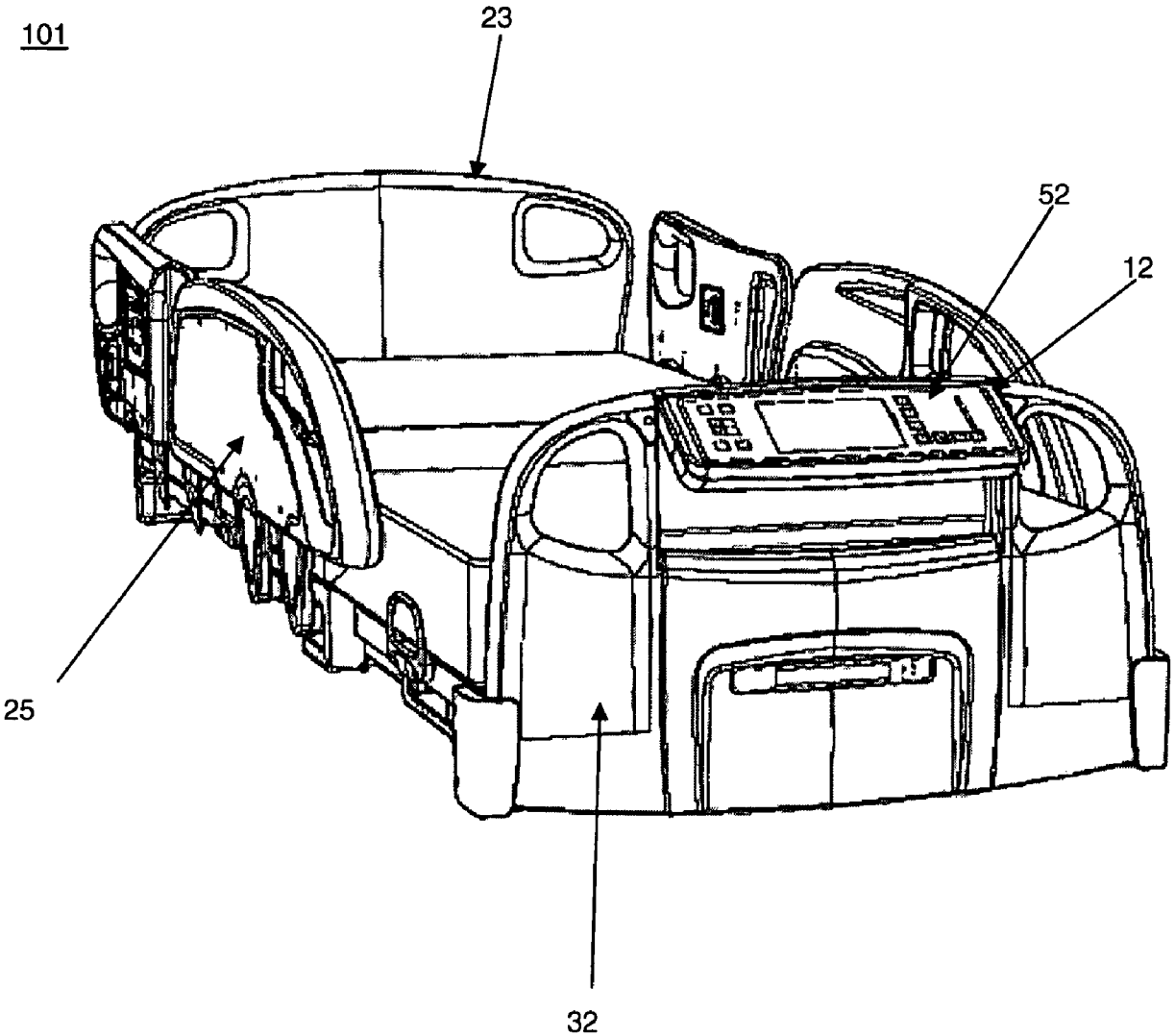
FIG. 5 is a perspective view of a patient support apparatus with the control apparatus of FIG. 4, wherein the control apparatus is in an operational position.

In another embodiment of the present invention, and as illustrated in FIGS. 4 and 5, the control apparatus 12 is operatively coupled to the foot panel 32 of a patient support apparatus 101. The coupling device can be designed as a rotational joint connection (not shown) which is configured to enable substantially about 270 degree rotation. In this configuration, the user interface 52 associated with the control apparatus 12 is facing the exterior of the patient support apparatus 101 when in a stored configuration thereby enabling viewing thereof in this stored position.

In the embodiments illustrated in FIGS. 1 to 5, rotational joint connections can be provided on opposite ends of the housing which are aligned along a first axis, in order to enable rotation of the housing relative to the patient support apparatus about the first axis. The relative location of each rotational pivot can be determined based on the desired relative rotation between the housing and the patient support apparatus.

In one embodiment, each rotational joint connection can comprise a pin and a mating aperture, which are located on either the housing or the patient support apparatus, and at a particular location a pin and a mating aperture are provided. For example, the pins can be associated with the housing, the patient support apparatus or both. In order to reduce the friction during relative movement of a pin within an aperture, a friction reducing substance, for example grease, Teflon® or other material as would be readily understood can be provided on the contact surface between the pin and the aperture. In another embodiment, a bearing system can be provided therebetween.

In one embodiment of the present invention, one or more of the rotational joint connections are hollow in order to provide the passage of wires or cables therethrough, thereby enabling wired interconnection between the control module and the patient support apparatus.

In one embodiment of the present invention, the coupling device comprises a automatic movement system which can be configured to move the control apparatus from a stored position to an operational position and optionally vice versa. In this embodiment, a user can activate the automatic movement system thereby initiating the movement of the control apparatus.

In one embodiment of the present invention, the automatic movement can be configured as a spring system, which upon release of a restraining device holding the control apparatus in a stored position, the spring system can rotate the control apparatus to an operational position. The spring system can be configured as a coil spring, linear spring or other spring configuration as would be readily understood by a worker skilled in the art.

In one embodiment of the present invention, the automatic movement system is a motorised system which can provide relative movement between the control apparatus and the patient support apparatus. The motorized system can be positioned within either the control module or the patient support apparatus and can be configured in a number of ways as would be known to a worker skilled in the art. In one embodiment of the present invention, the relative movement between the control apparatus and the patient support apparatus is monitored by the control module and can be adjusted, in real-time or on command, in order to maintain a predetermined accessibility and visibility to the control apparatus by the health care provider. In this embodiment, the motorised system is operatively coupled to the control module which may further comprise a positioning sensor, thereby enabling the control module to determined if adjustment of the relative position of the control apparatus is required.

Figure 6:
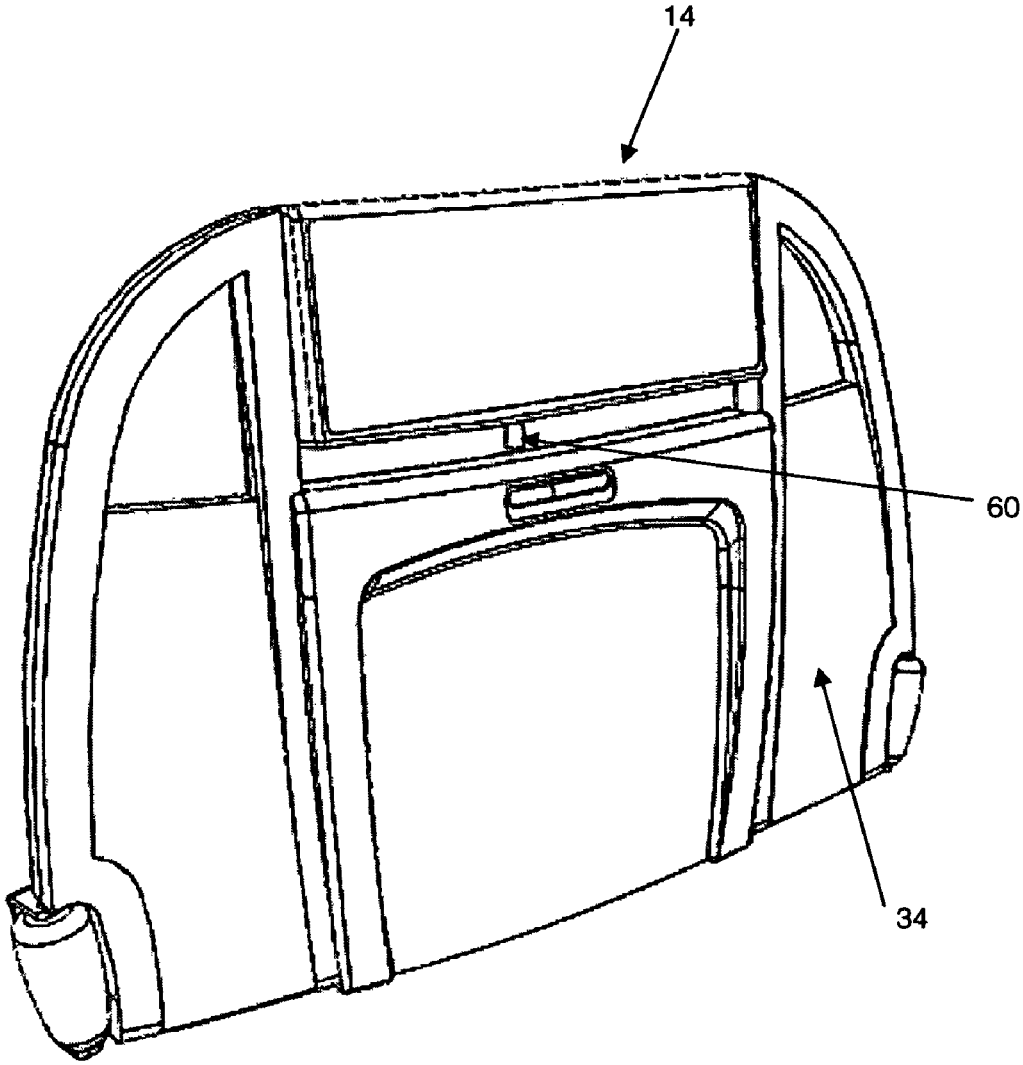
FIG. 6 is a perspective end view of a foot panel or a head panel of a patient support apparatus with a control apparatus according to one embodiment of the present invention, wherein the control apparatus in a stowed position.
Figure 7:
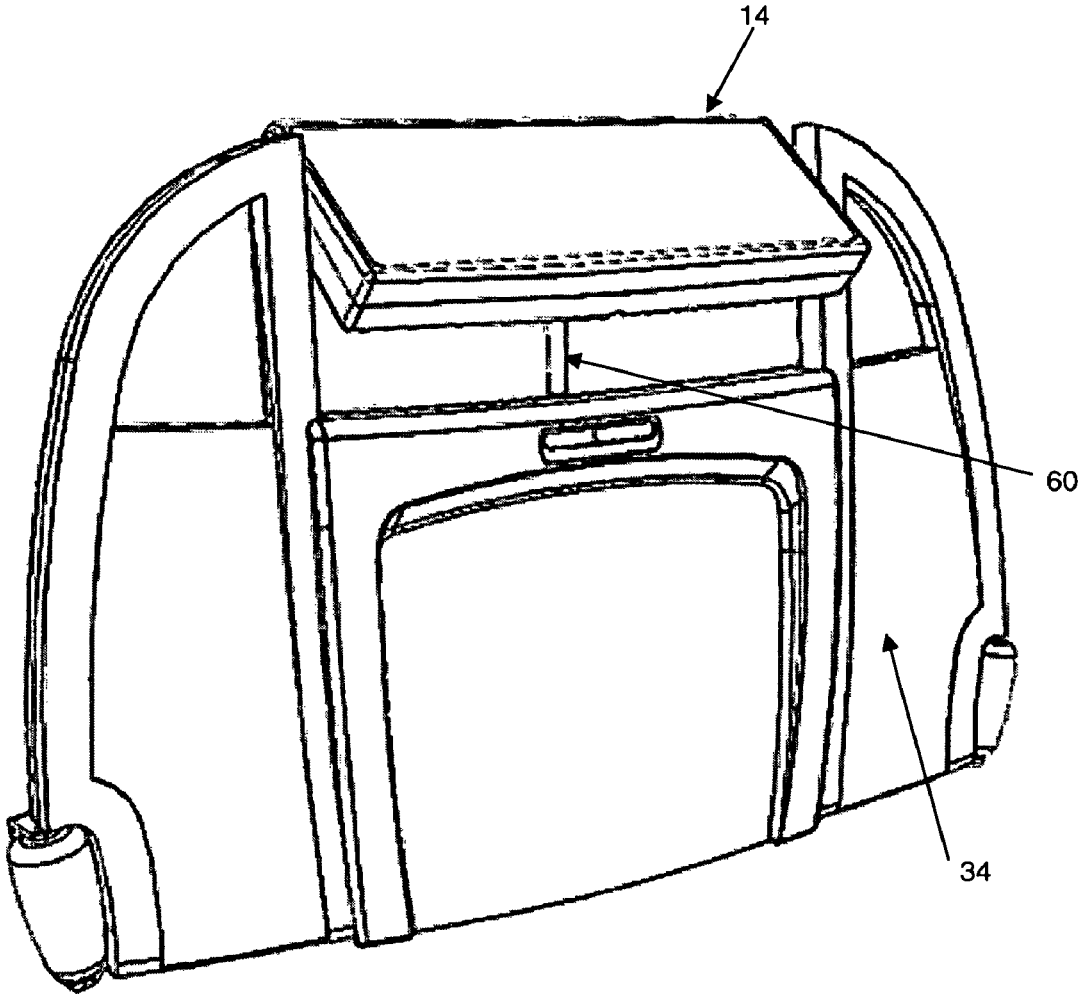
FIG. 7 is a perspective exterior end view of a foot panel or a head panel of a patient support apparatus with the control apparatus of FIG. 6, wherein the control apparatus is in an operational position.
Figure 8:
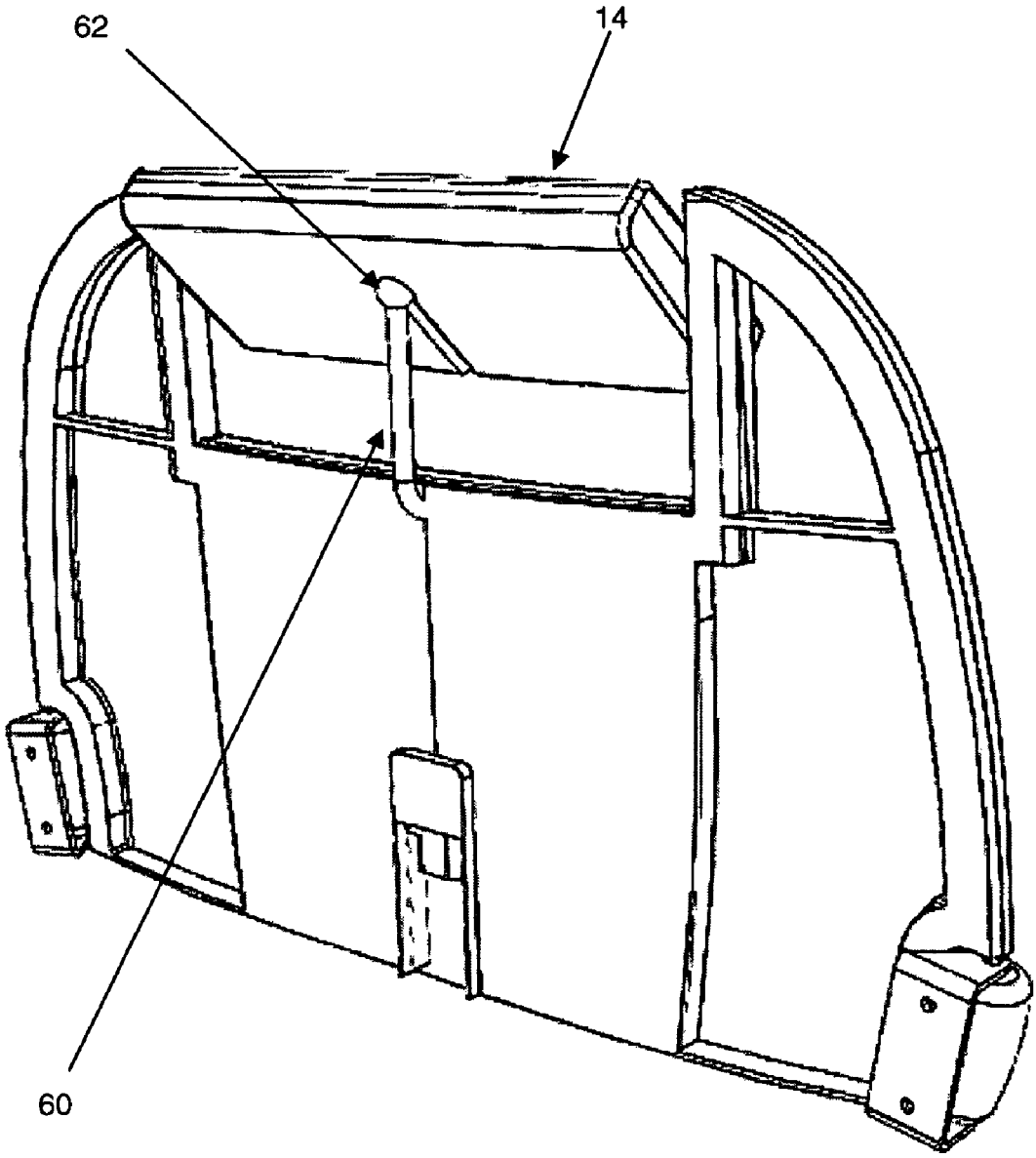
FIG. 8 is a perspective interior end view of a foot panel or a head panel of a patient support apparatus with the control apparatus of FIG. 6, wherein the control apparatus is in an operational position.

In one embodiment of the present invention as illustrated in FIGS. 6 to 8, the coupling device can further comprise a telescopic mechanism 60 which can provide a means for adjustment of the orientation of the control apparatus relative to the patient support apparatus. A rotational connection 62 couples the telescopic mechanism to the control apparatus thereby compensating for the relative movement therebetween.

Multiple Interconnected Slots and Pin Connection

Figure 9:
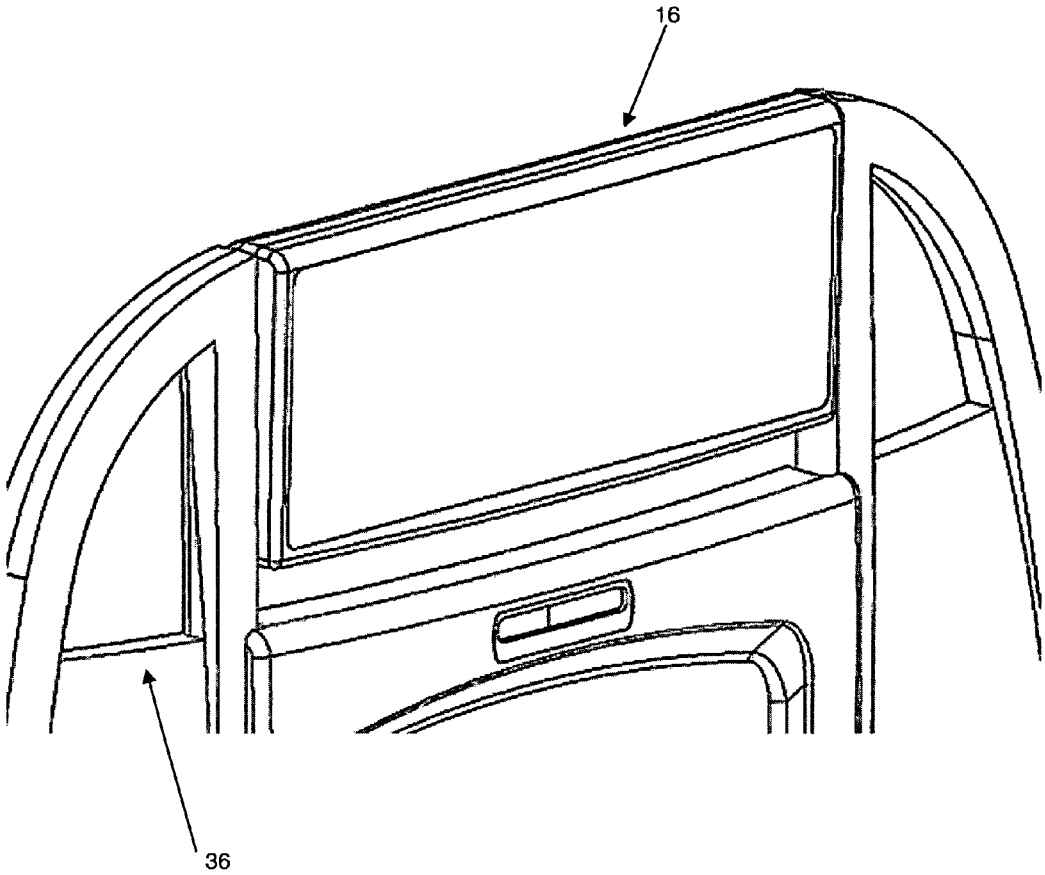
FIG. 9 is a perspective view of a control apparatus according to one embodiment of the present invention, wherein the control apparatus is in a stored position.
Figure 10:
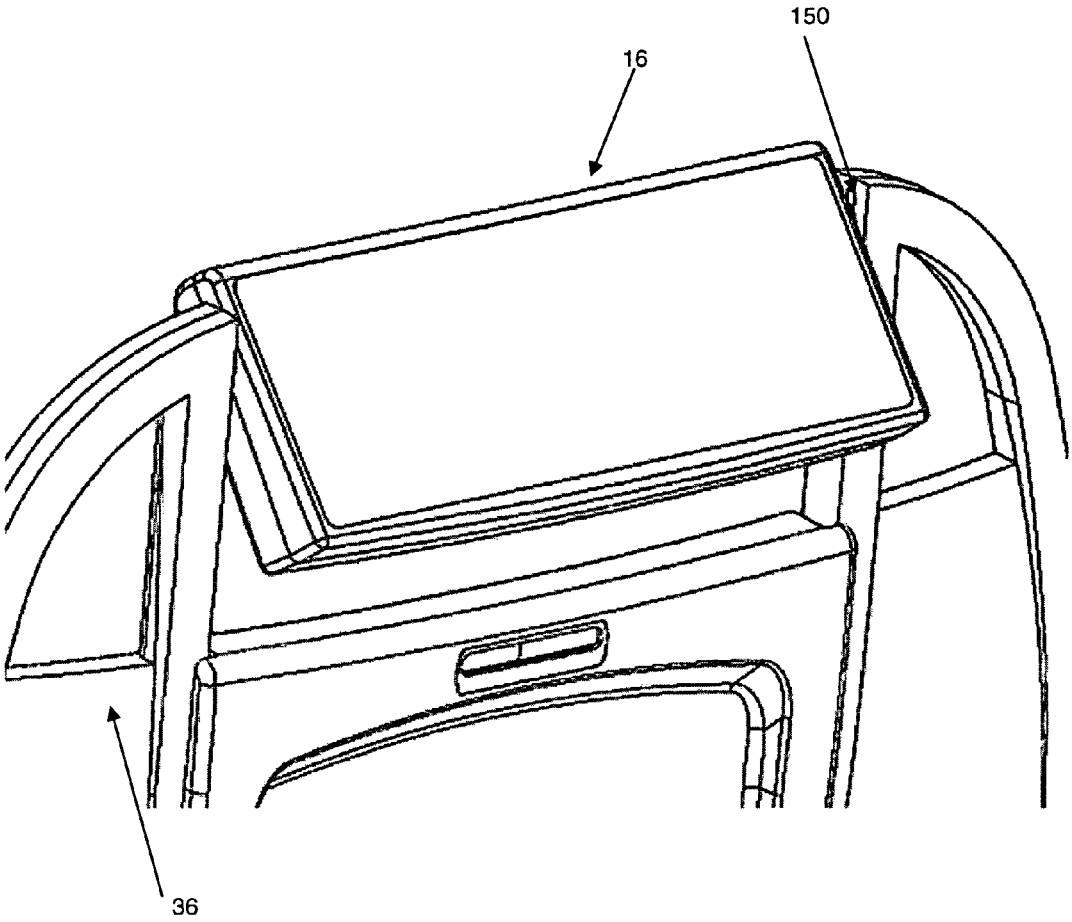
FIG. 10 is a perspective view of the control apparatus of FIG. 9, wherein the control apparatus is in a first operational position.
Figure 11:
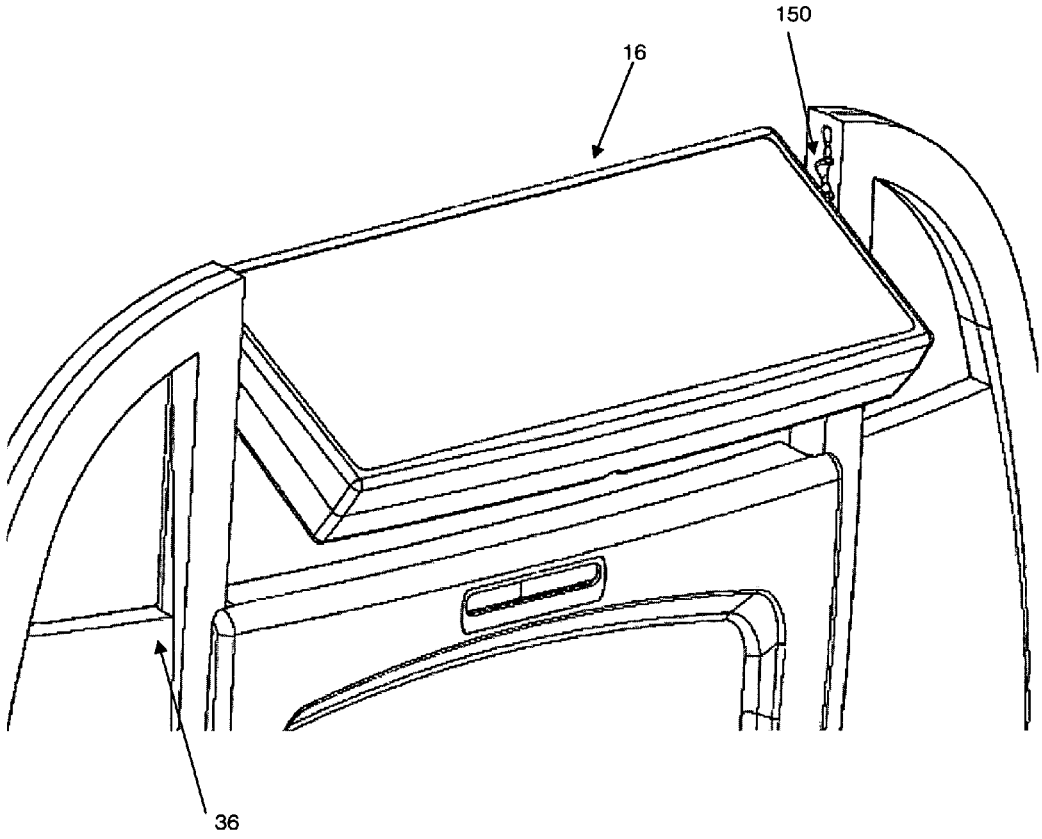
FIG. 11 is a perspective view of the control apparatus of FIG. 9, wherein the control apparatus is in a second operational position.

In one embodiment of the present invention, the coupling device can be comprise multiple interconnected slots which guide the movement of one or more pins therein. FIGS. 9 to 13 illustrate one embodiment of the coupling device which is configured in this manner. FIGS. 9 to 11, illustrate multiple positions of the control apparatus 16 relative to the foot panel 36, wherein the multiple interconnected slots created in a planar structure 150 is mounted on the foot panel and the pins are associated with the housing of the control apparatus. The multiple interconnected slots associated with a first side of the foot panel facing the control apparatus will be mirrored on the opposite side of the foot panel facing the opposite side of the control apparatus. In one embodiment of the present invention, the coupling device comprises two, three, four or more interconnected slots, wherein the interconnected slots can intersect at one or more different angles.

In one embodiment of the present invention, the planar structure has a first substantially vertical slot 152 which is intersected by three angled slots, 153, 155 and 157. The two pins 154 coupled to the housing can translate and rotate within the multiple interconnected slots, thereby providing a means for adjustment of the relative orientation of the control apparatus with respect to the patient support apparatus.

Figure 12:
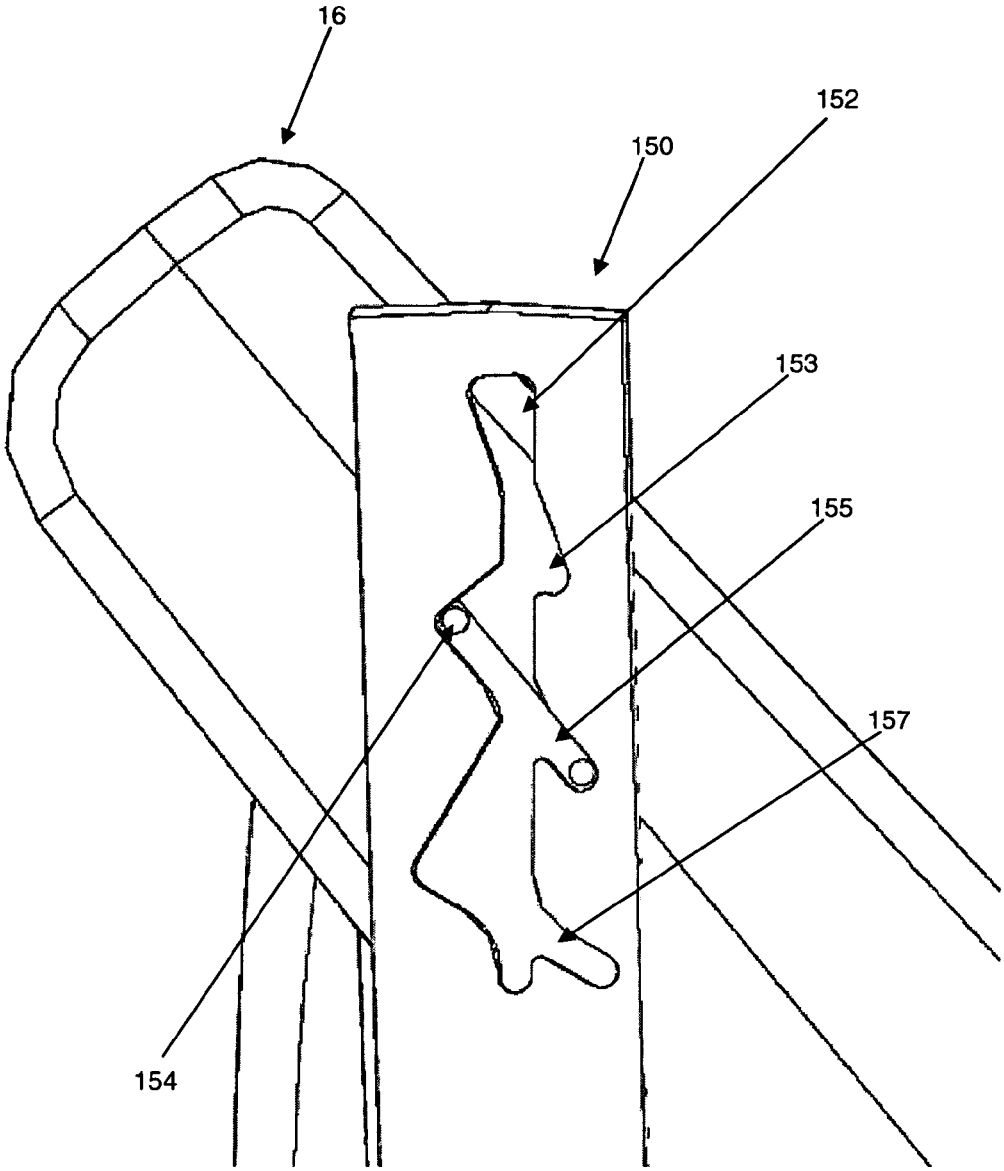
FIG. 12 is an end view of the control apparatus of FIG. 9 illustrating a coupling device according to one embodiment of the present invention, wherein the control apparatus is in a first operational position.
Figure 13:
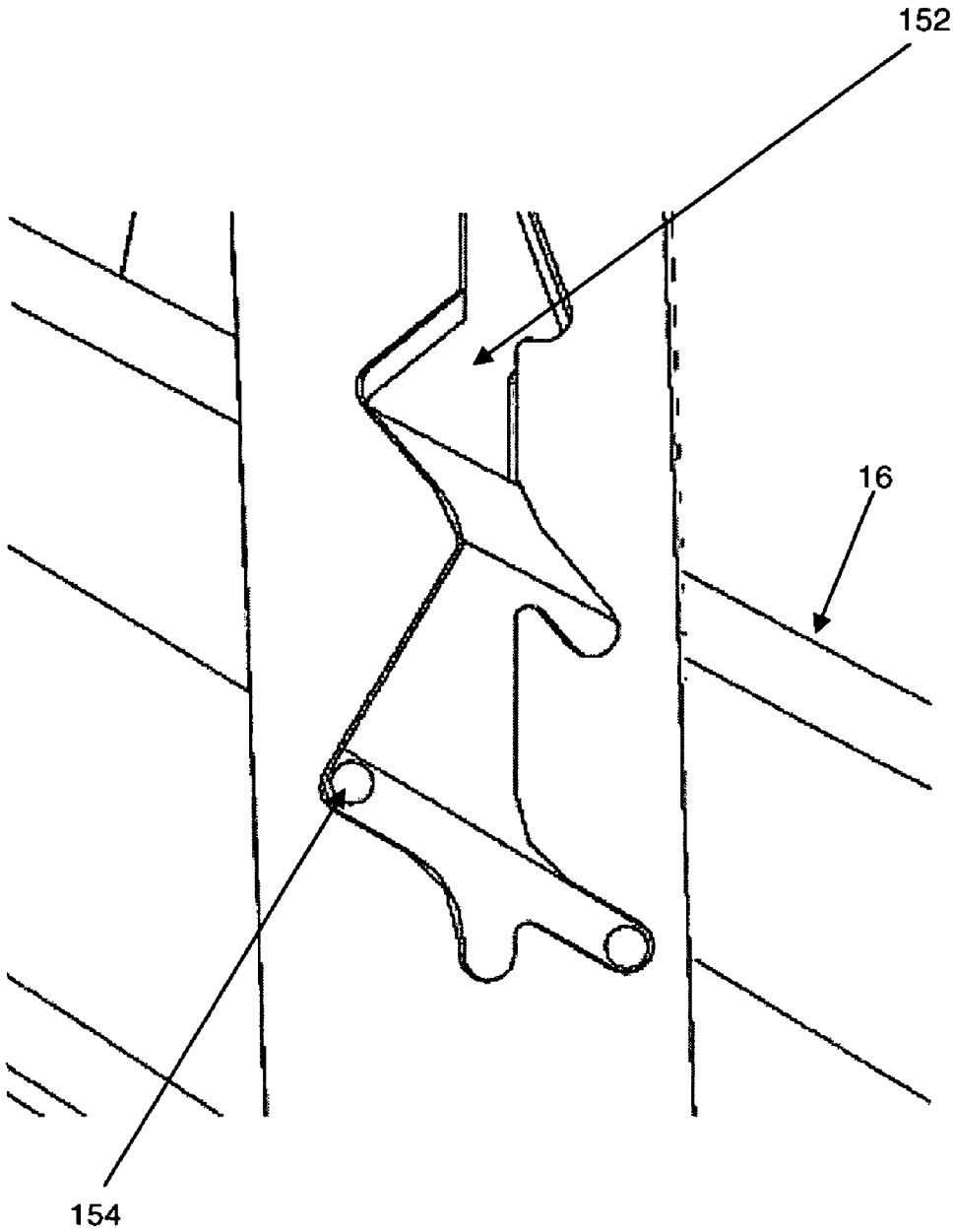
FIG. 13 is an end view of the control apparatus of FIG. 9 illustrating the coupling device of FIG. 12, wherein the control apparatus is in a second operational position.
Figure 14:
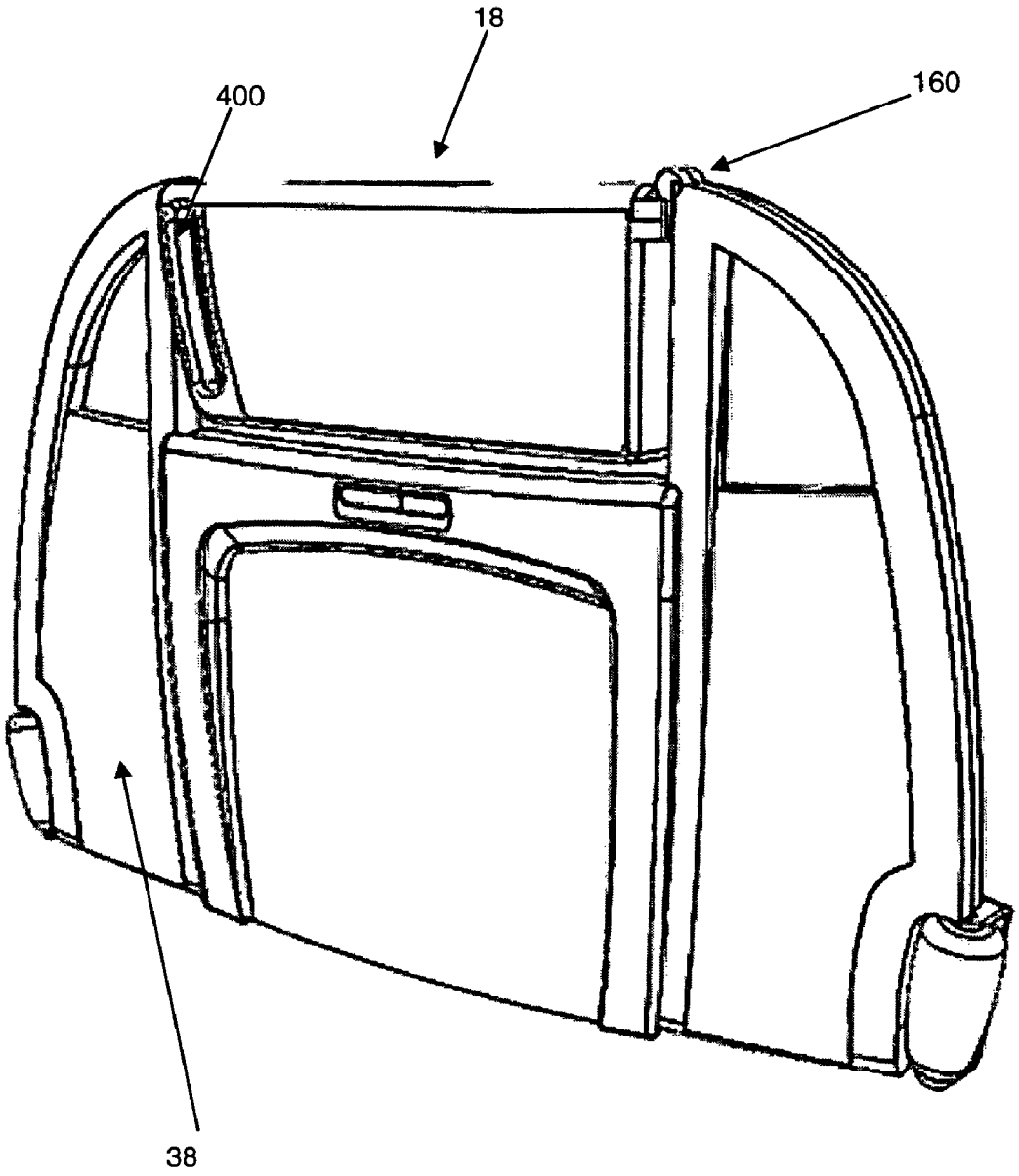
FIG. 14 is a perspective view of a foot panel or a head panel with a control apparatus according to one embodiment of the present invention, wherein the control apparatus is in a stored position.
Figure 15:
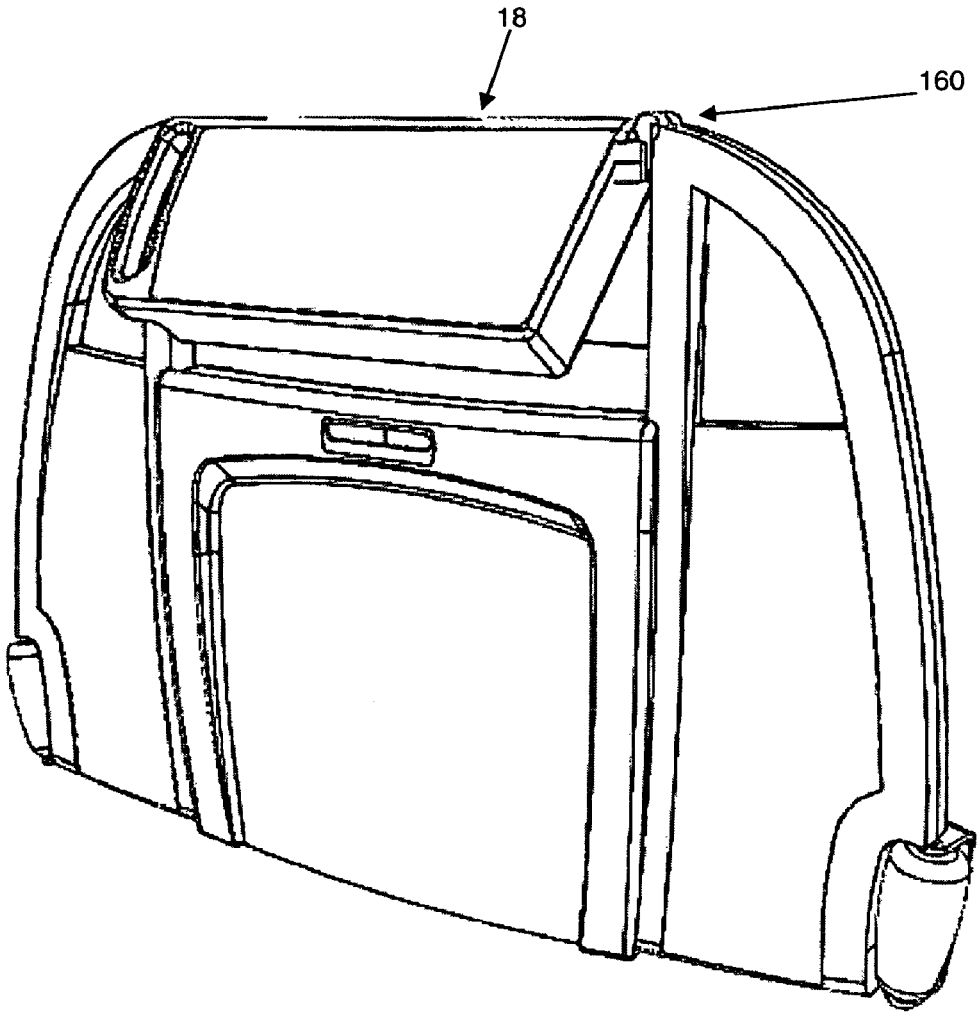
FIG. 15 is a perspective view of a foot panel or a head panel with the control apparatus of FIG. 14, wherein the orientation of the control apparatus is between a stowed position and an operational position.
Figure 16:
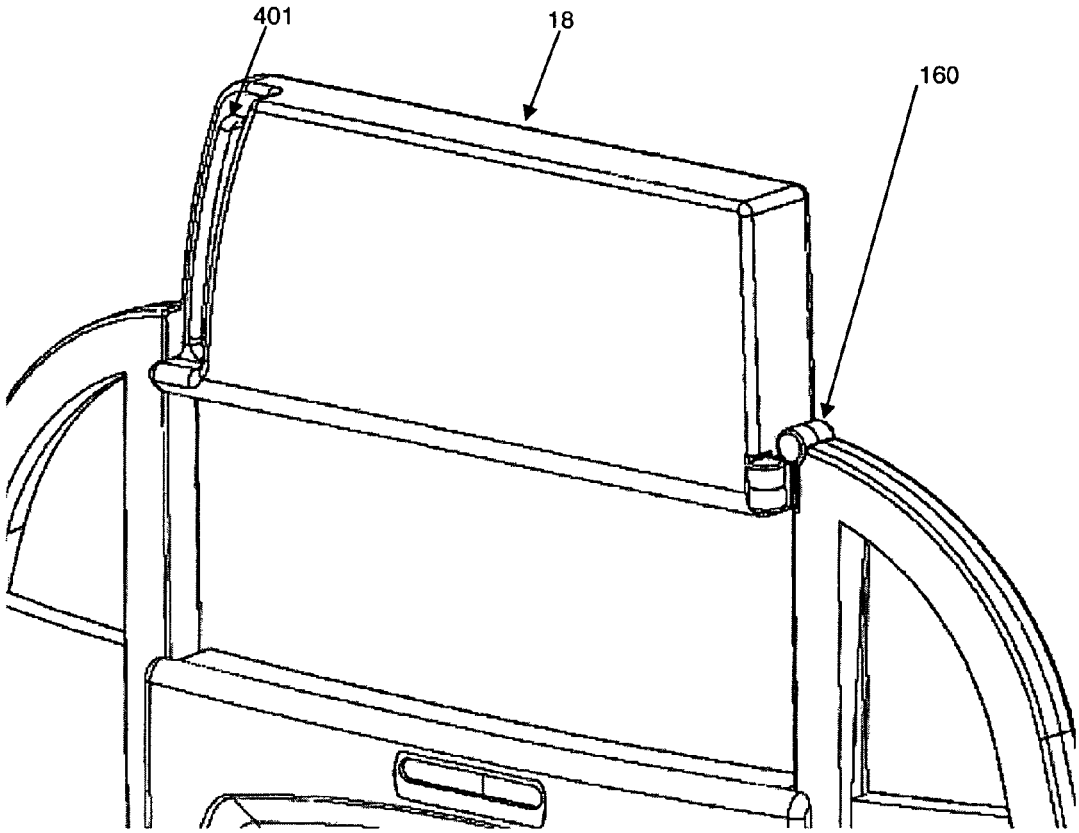
FIG. 16 is a perspective view of a foot panel or a head panel with the control apparatus of FIG. 14, wherein the orientation of the control apparatus is in an operational position.
Figure 17:
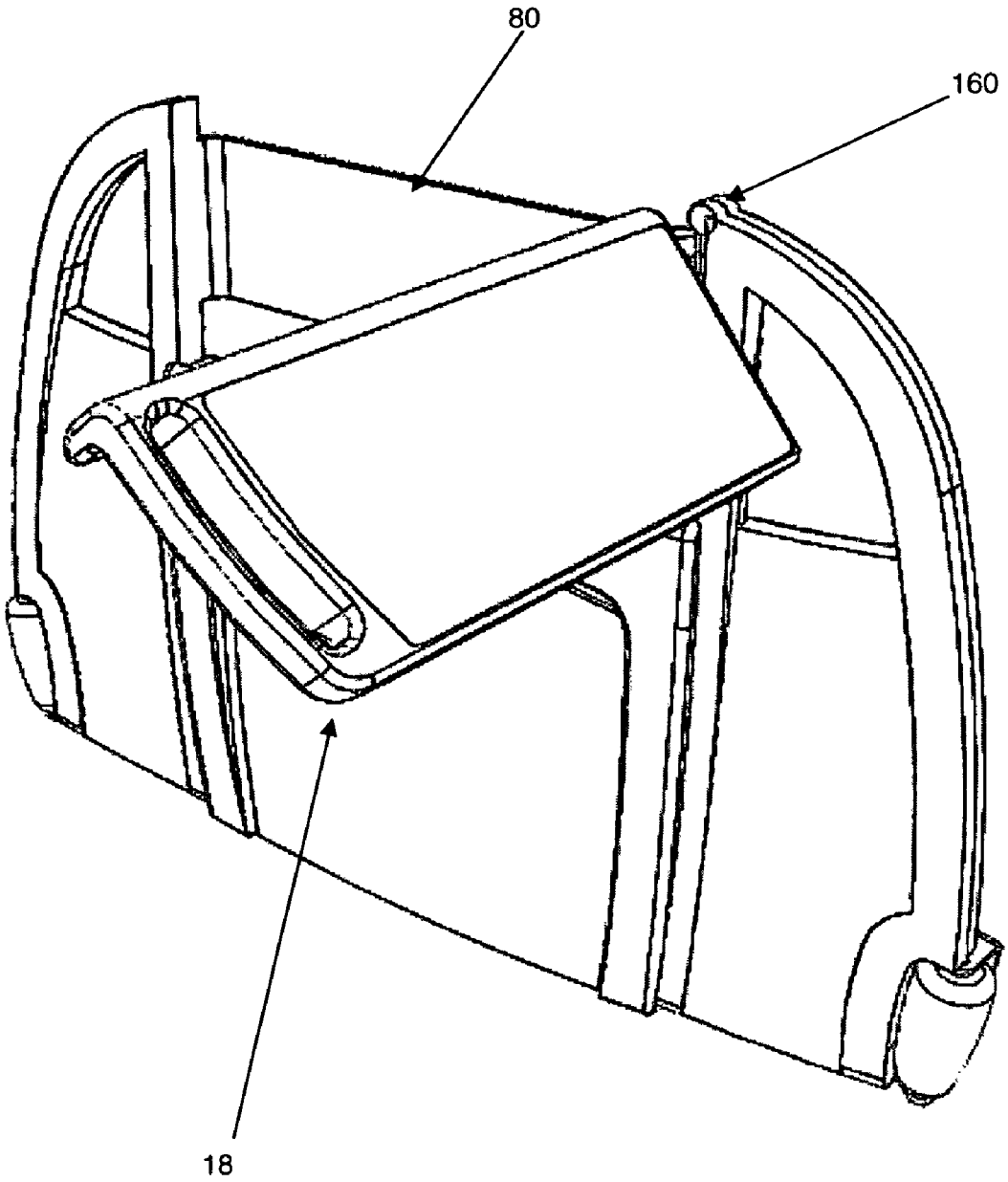
FIG. 17 is a perspective view of a foot panel or a head panel with the control apparatus of FIG. 14, wherein the orientation of the control apparatus is in another operational position.
Figure 18:
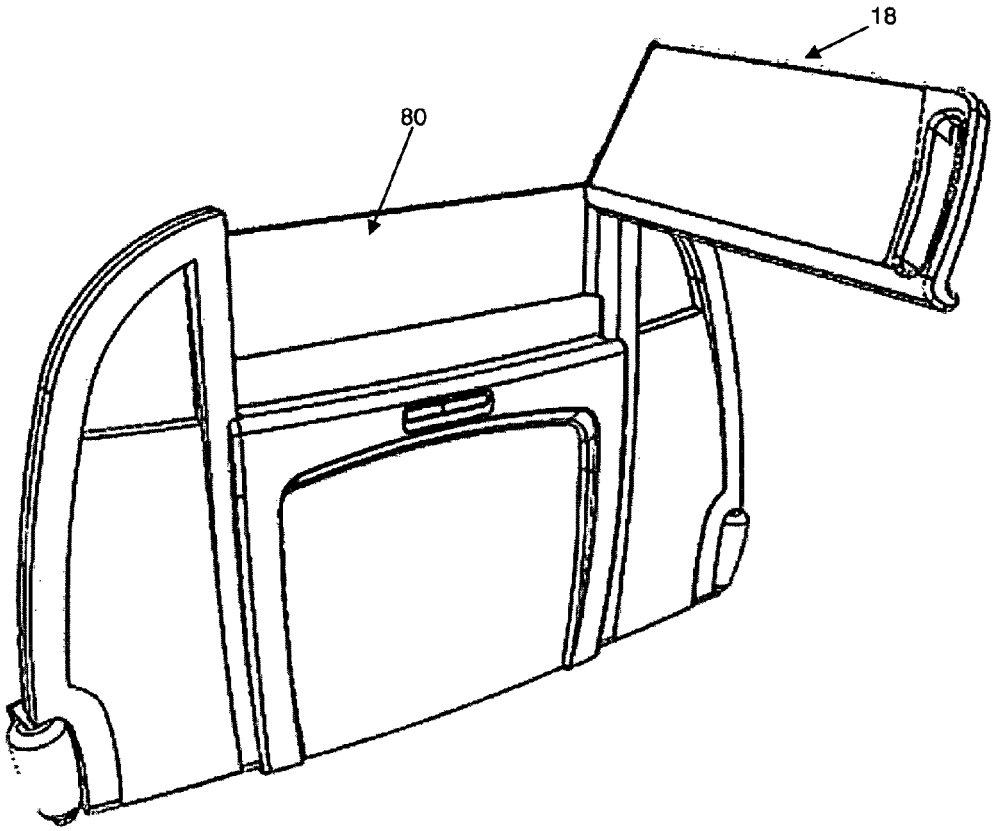
FIG. 18 is a perspective view of a foot panel or a head panel with the control apparatus of FIG. 14, wherein the orientation of the control apparatus is in another operational position.
Figure 19:
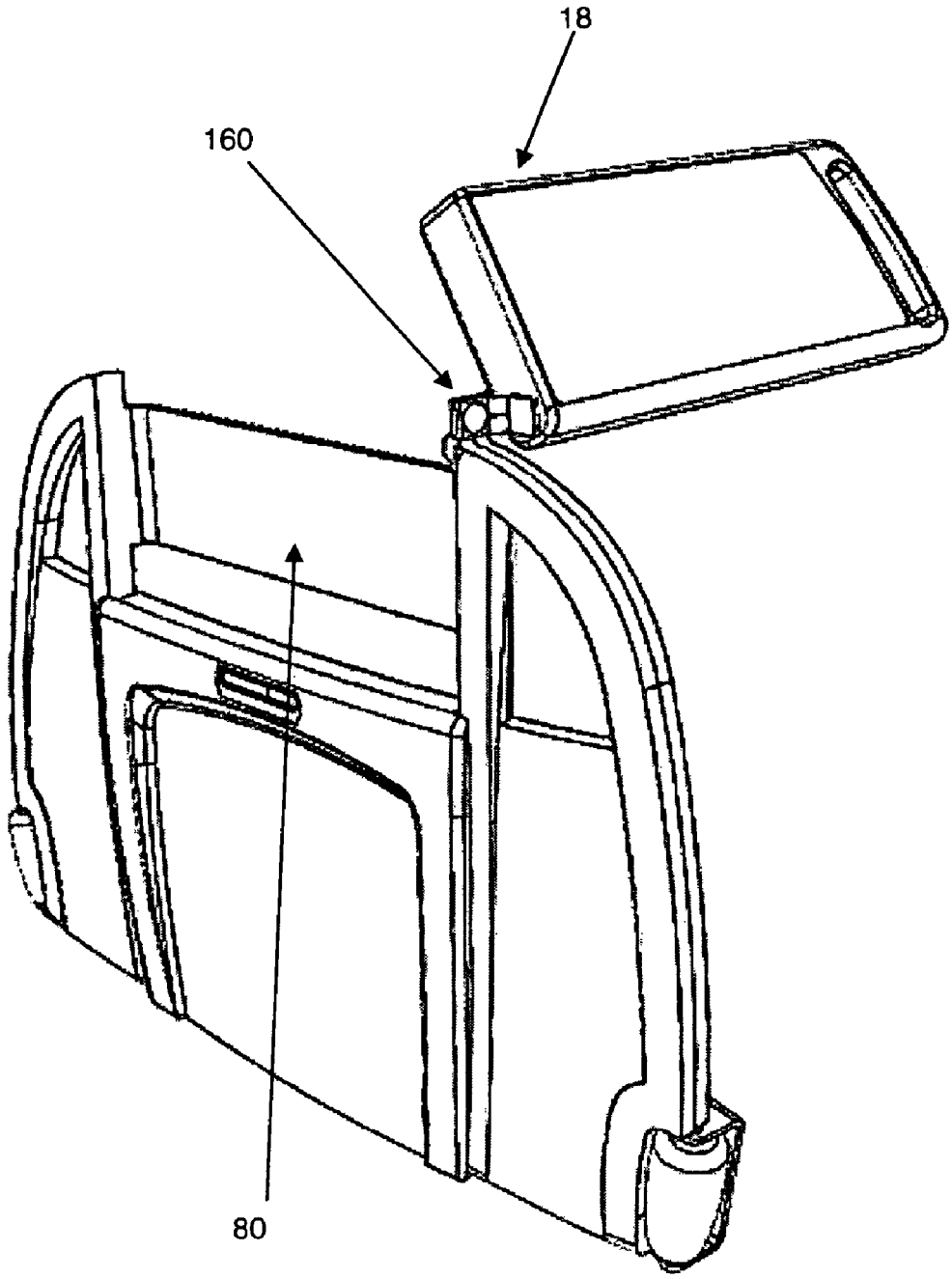
FIG. 19 is a perspective view of a foot panel or a head panel with the control apparatus of FIG. 14, wherein the orientation of the control apparatus is in another operational position.
Figure 20:
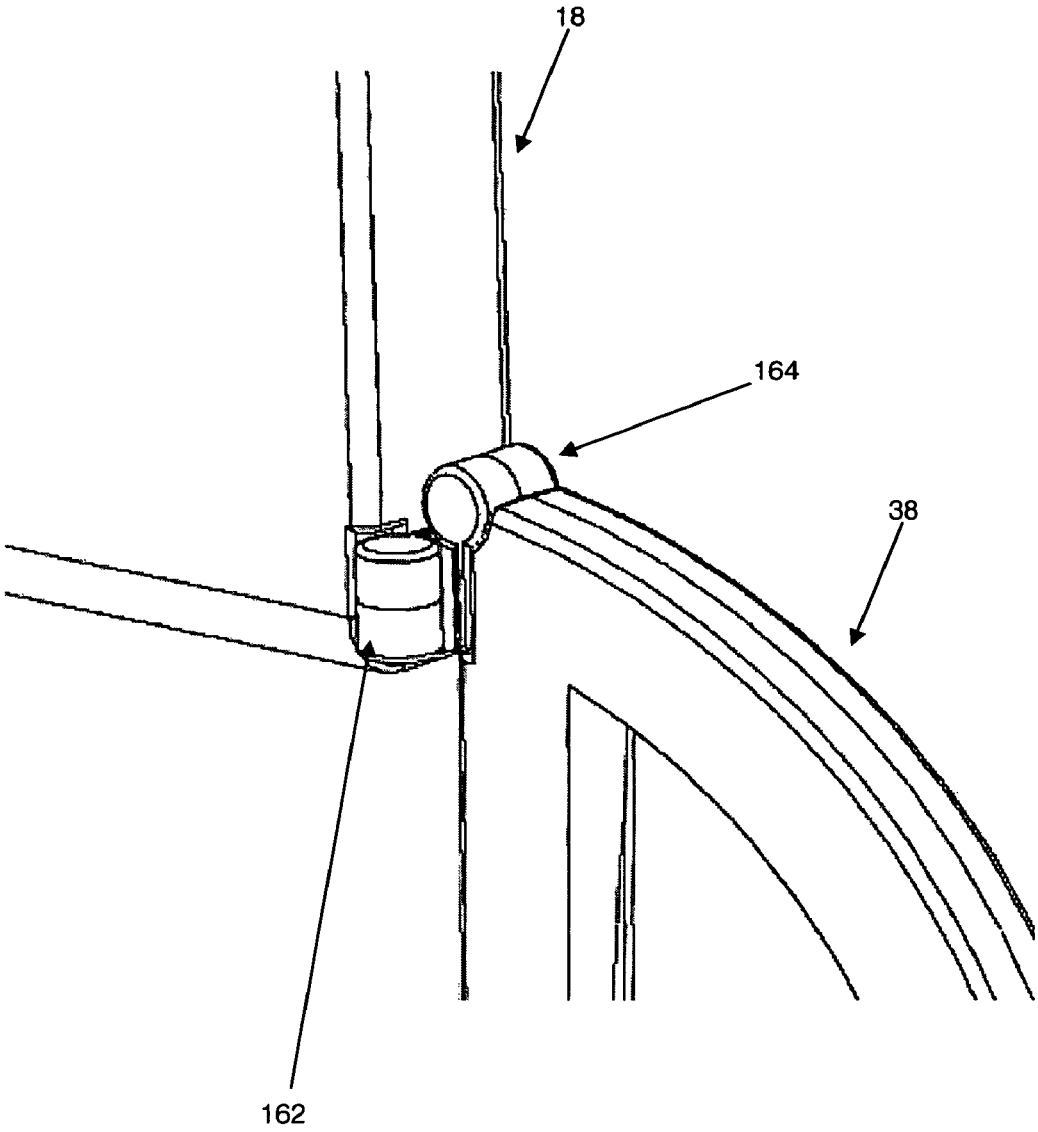
FIG. 20 is a perspective view of a coupling device according to one embodiment of the present invention, wherein the control apparatus is in a first position.
Figure 21:
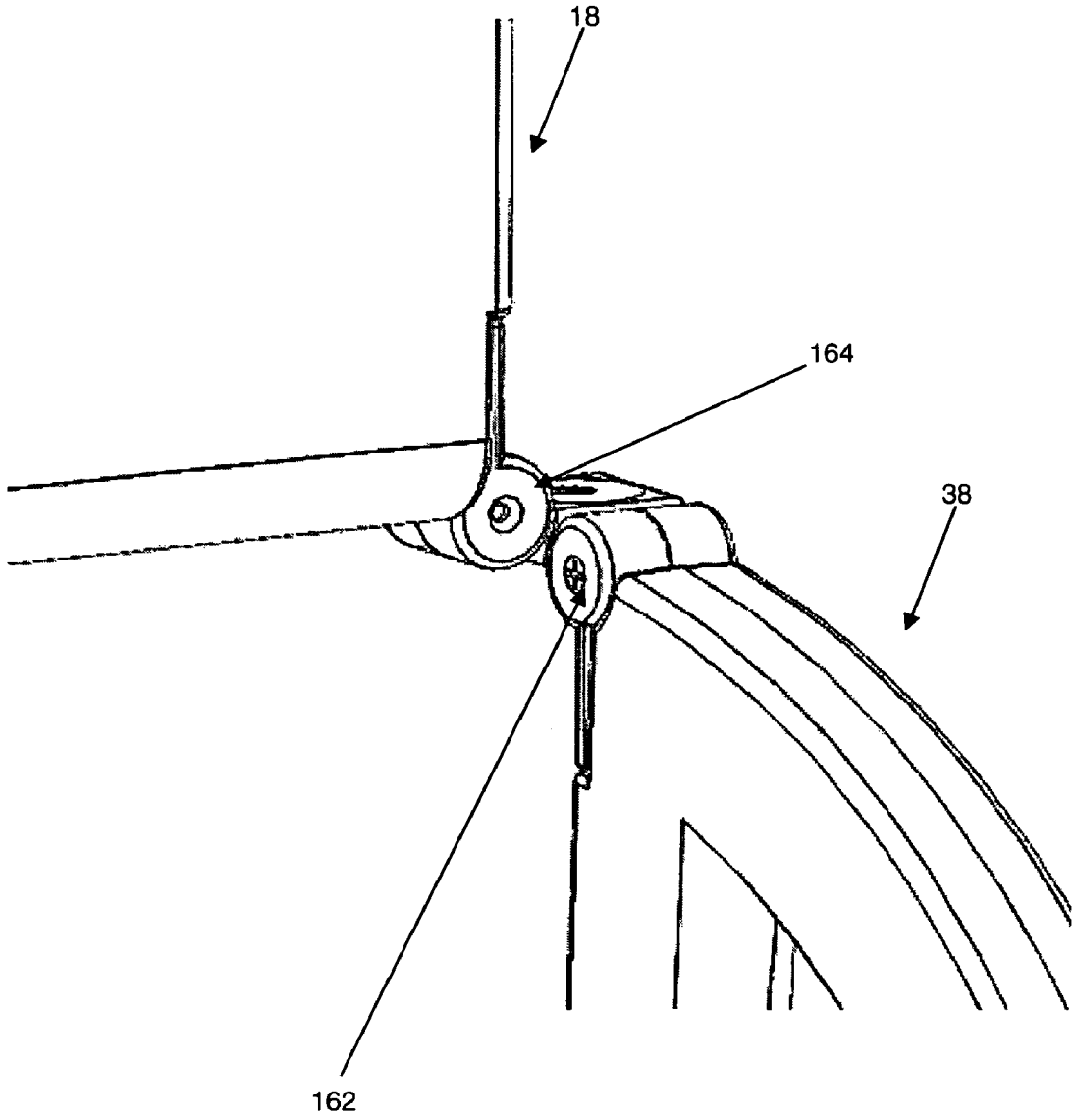
FIG. 21 is a perspective view of the coupling device of FIG. 20, wherein the control apparatus is in a second position.
Figure 22:
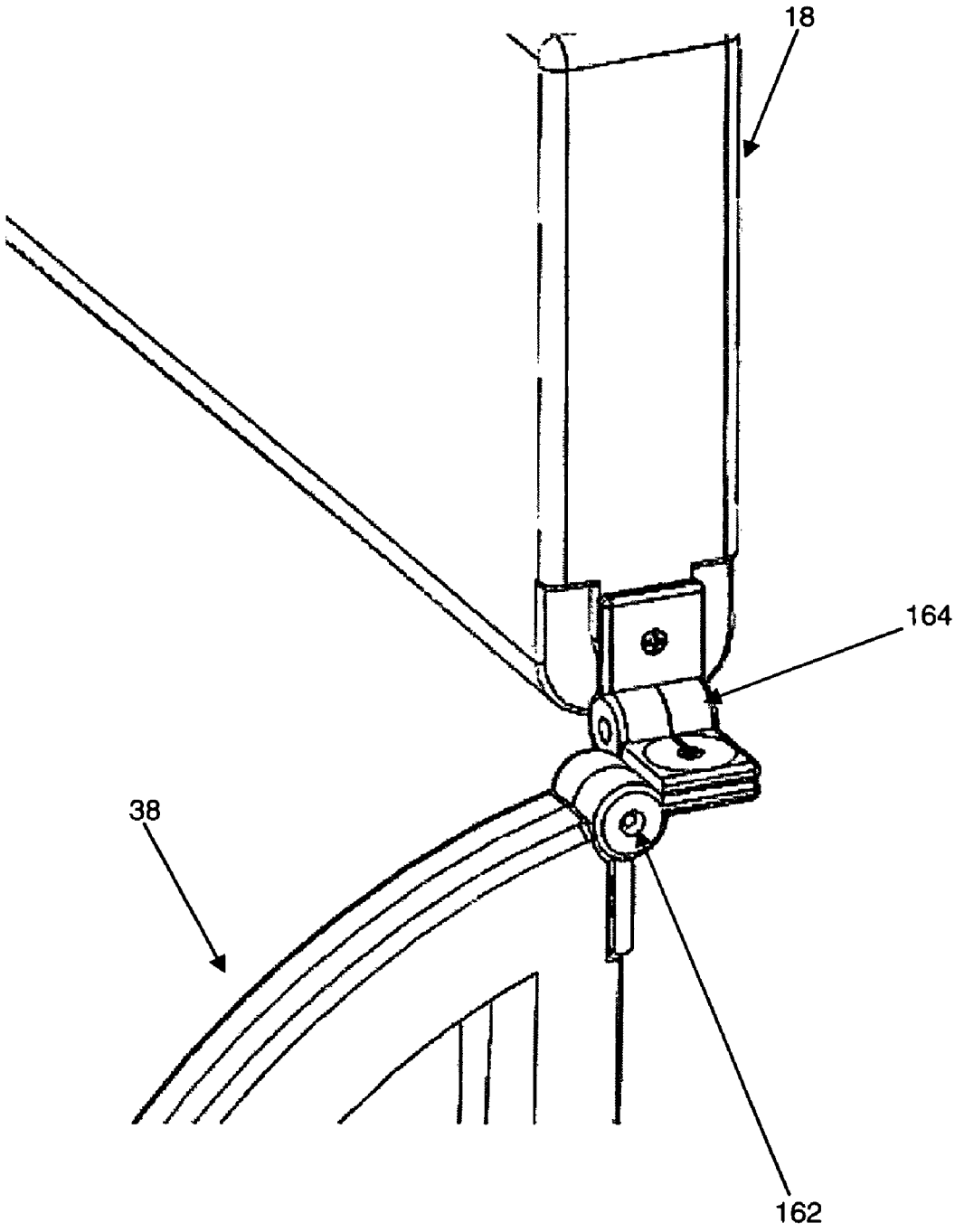
FIG. 22 is another perspective view of the coupling device FIG. 21.
Figure 23:
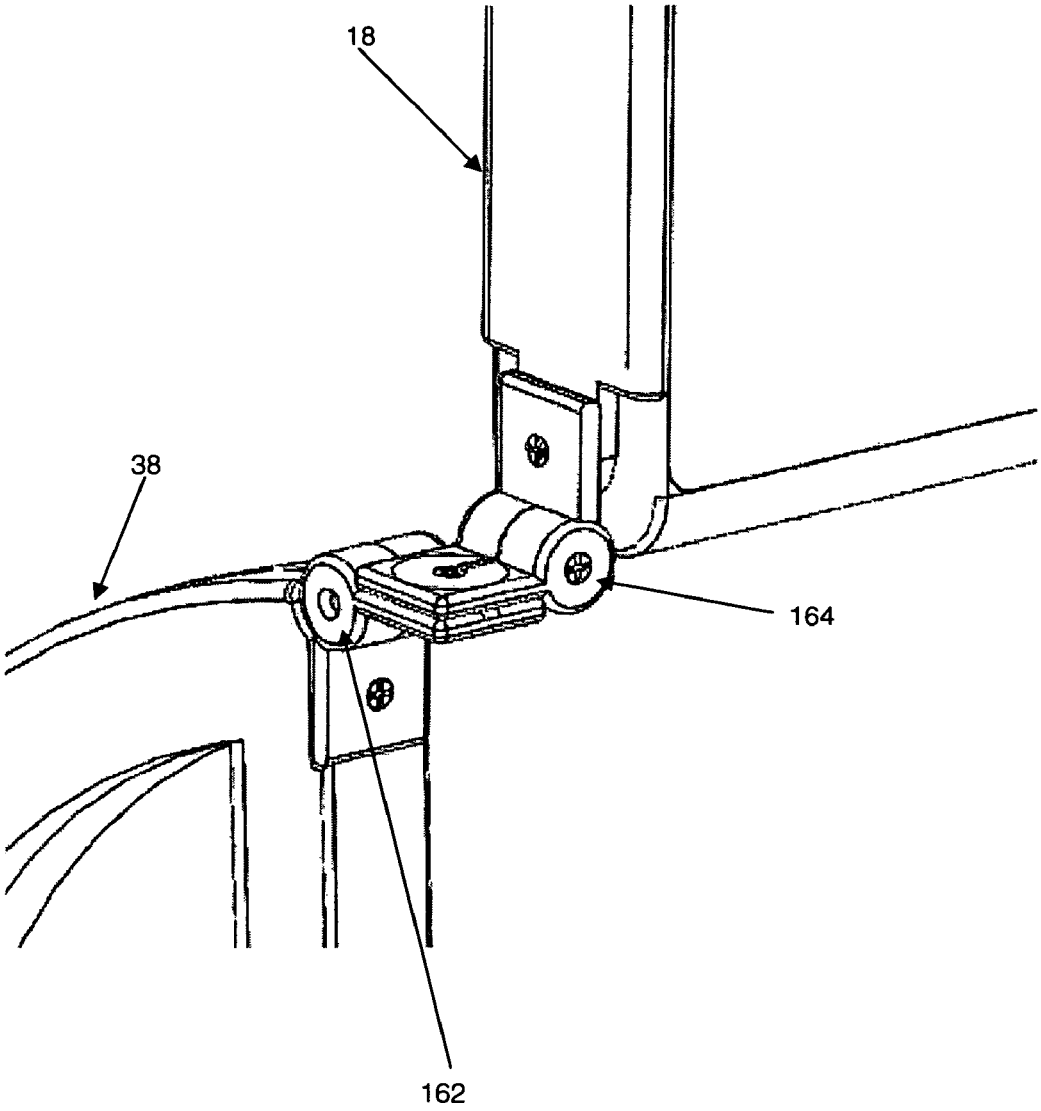
FIG. 23 is another perspective view of the coupling device of FIG. 21.

As illustrated in FIGS. 12 and 13, the three angled slots have varying slopes associated therewith, thereby enabling the control apparatus to be positioned in varying operative orientations wherein each operative orientation has associated therewith a different slot and thus a different angle.

In another embodiment of the present invention, the angled slots can be configured to be parallel, and as such the operative orientation of the control apparatus will be consistent, however by changing the angled slot with which the pins are associated, can vary the height of the control apparatus can be adjusted.

In one embodiment of the present invention, the pins has bearings operatively connected thereto, wherein the bearings can reduce the wearing of the pins and the multiple interconnected slots, while also reducing high contact stresses therebetween and facilitating movements from one position to another and therefore reducing the applied force required to accomplish this movement.

Multiple Rotational Joint Connection

In one embodiment of the present invention the coupling device is configured as a multiple rotational joint connection wherein relative rotation between the control apparatus and the patient support apparatus can be provided about two, three, four or more axes. In one embodiment of the present invention, a multiple rotational joint connection provides relative rotation between the control apparatus and the patient support apparatus about two or three orthogonal axes.

In one embodiment of the present invention, a coupling device is configured as a multiple rotational joint connection as illustrated in FIGS. 14 to 25. In this embodiment and as illustrated in FIGS. 14 to 19 the coupling device 160 is configured as a multiple rotational joint connection which provides relative rotation between the control apparatus 18 and the foot panel 38 about three or four axes. For example, and with reference to FIG. 14 this embodiment of the present invention is illustrated in a stored position. The control apparatus can comprise one or more handle regions 400 and 401, for example on opposite sides of the control apparatus, which can provide a user the ability to grip the control apparatus in a sufficient manner in order to rotate it relative to the patient support apparatus into a desired operable orientation. FIGS. 15 to 19 illustrate this embodiment of the present invention in a plurality of different relative orientations between the control apparatus the patient support apparatus.

In one embodiment of the present invention, in the stored orientation of the control apparatus, the user interface associated with the control apparatus is facing a rear panel 80, which can provide protection thereto in addition to protecting the control apparatus from impact from a patient using the patient support apparatus. Alternately, in the stored orientation of the control apparatus, the user interface may be facing the exterior of the patient support apparatus and therefore may be usable and visible in the stored configuration.

FIGS. 20 to 23 illustrate multiple close up views of a coupling device configured as a multiple rotational joint connection according to one embodiment of the present invention. This coupling device provides relative rotation between the control apparatus and the foot panel of the patient support apparatus about three or four axes. A first rotational joint connection 162 provides relative rotation about a first axis, and second rotational joint connection 164, provides relative rotation about a second axis orthogonal to the first axis.

Figure 24:
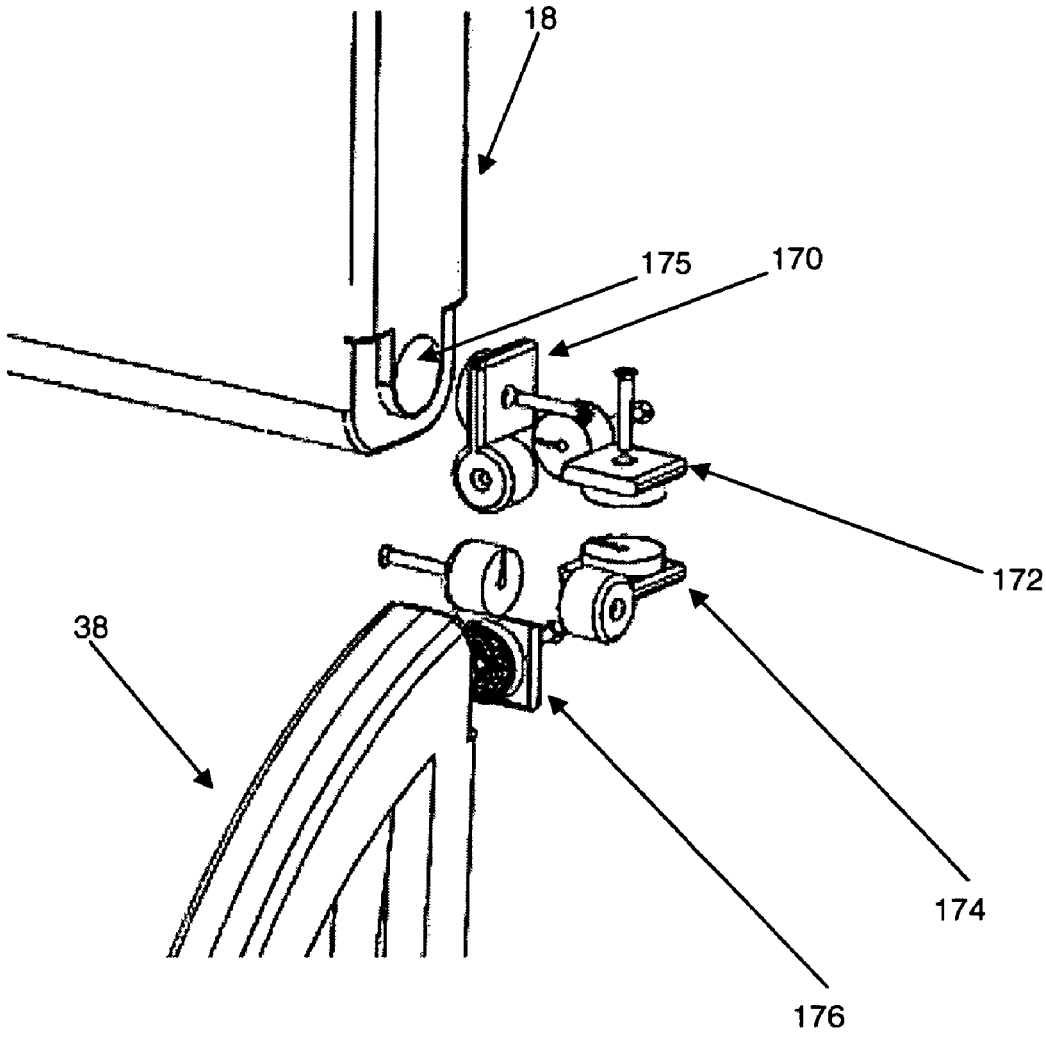
FIG. 24 is an exploded view of the coupling device of FIG. 21.

In one embodiment of the present invention and with reference to FIG. 24, which illustrates an exploded view of the coupling device, a third rotational joint connection 175 is substantially concealed by the housing of the control apparatus, wherein this third rotational joint connection provides relative rotation about a third axis. The third rotational joint connection can be configured as a bearing system concealed within the housing of the control apparatus, wherein remaining portions, namely the first and second rotational joint connections 164 and 162, of the coupling device can be connected to this bearing system.

In an alternate configuration the coupling device as illustrated in FIG. 24, can additionally provide rotational movement about a fourth axis defined by the mating interfaces between component 172 and component 174.

Figure 25:
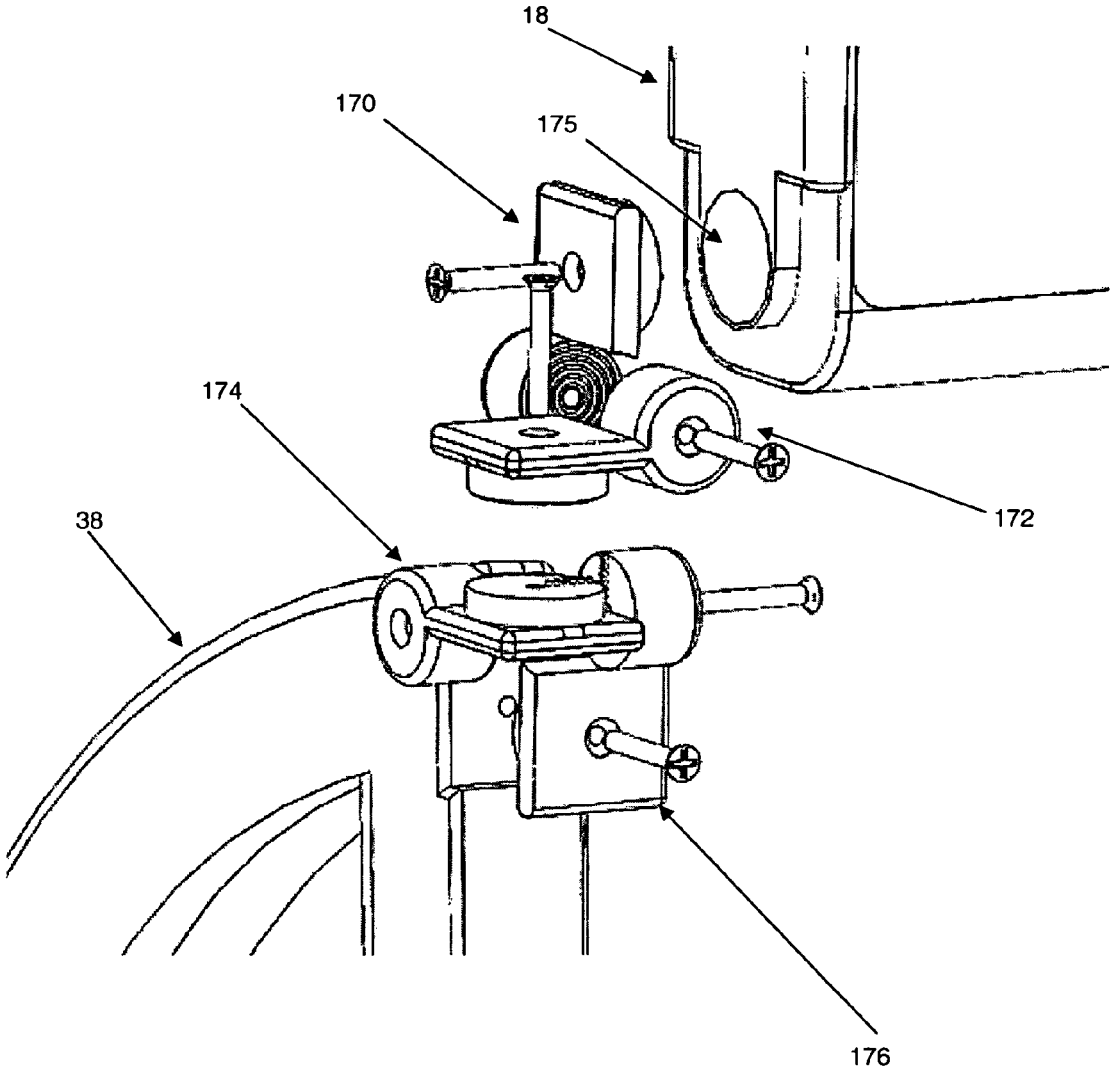
FIG. 25 is another exploded view of the coupling device of FIG. 21.

In one embodiment of the present invention, in order to provide rotation about the first and second axes, the coupling device is formed from four separate interconnecting components, which upon coupling together provide the desired relative rotational movement between the housing and the foot panel. As illustrated in FIGS. 24 and 25, rotation about the first axis is provided by mating components 176 and 174, wherein component 176 is fixedly connected to the foot panel 38 of the patient support apparatus. The mating discs of components 176 and 174 are movably coupled together and provide rotation about the central connection therebetween which defines the first axis. Furthermore as illustrated in FIGS. 24 and 25, rotation about the second axis is provided by mating components 170 and 172, wherein component 170 is fixedly connected to a third rotational axis configured within the housing of the control apparatus 18. The mating discs of components 170 and 172 are movably coupled together and provide rotation about the central connection therebetween which defines the second axis. In addition, component 172 and 174 are fixedly connected thereby forming the complete coupling device.

In one embodiment of the present invention, the mating interfaces between component 176 and component 174 can configured in order to limit the friction therebetween, for example through the provision of a lubricant or Teflon® coating of the mating faces. This can provide a means for reducing the force required in order to rotate the control apparatus relative to the foot panel about this first axis. However, the friction or other restraining force provided between these mating faces must be sufficient in order to maintain a relative orientation of the control apparatus upon removal of a rotational force. This above discussion regarding the interface between component 176 and 174, can be equally applied to the interface between component 170 and component 172, in addition to the interface between component 172 and component 174.

Figure 26:
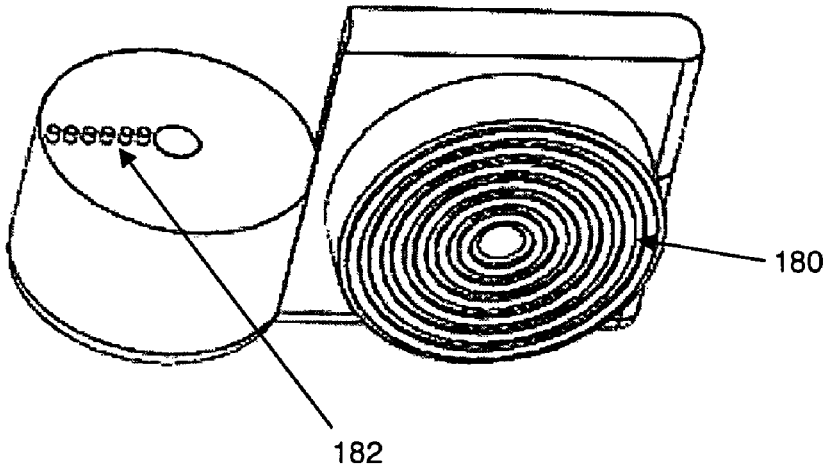
FIG. 26 is a perspective view of a first portion of a coupling device according to one embodiment of the present invention.
Figure 27:
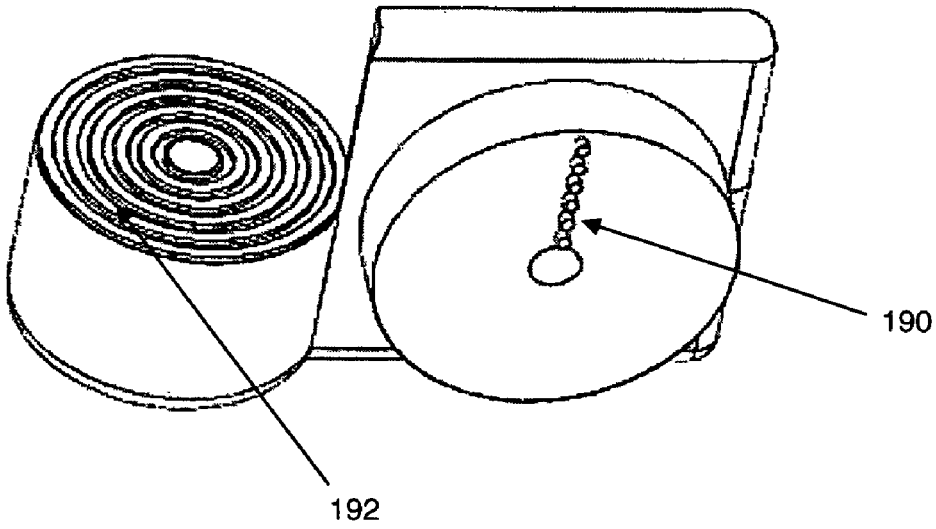
FIG. 27 is a perspective view of a second portion of a coupling device configured to mate with the first portion of FIG. 26.

In one embodiment of the present invention, the mating interface between components 176 and 174 and the mating interfaces between component 170 and component 172 can provide electrical connectivity therebetween thereby enabling power and/or data transfer between the control module and the patient support apparatus via the coupling device. For example and as illustrated in FIGS. 26 and 27, a first mating interface comprises two or more electrically conductive pin connections 182 or 190, and a second mating interface comprises two or more mating electrically conductive grooves 180 or 192 which are electrically isolated from each other. During relative rotation of the mating interfaces the electrically conductive pins travel within the mating circular grooves thereby providing electrical conductivity therebetween independent of the movement and relative orientation of the mating interfaces.

In one embodiment of the present invention, the electrical connection between a mating pin and groove can be enhanced by providing an electrically conductive gel or other electrically conductive deformable material within the groove.

In the embodiment illustrated in FIGS. 26 and 27, six electrical conductive pins and six corresponding electrically conductive grooves are provided, thereby providing six conductive pathways. In this configuration, the each of the six conductive pathways can provide an electrical pathway for the transmission of one of, for example, CAN high signal, CAN low signal, 24 Volt power source, 12 Volt power source, ground and a signal channel.

In an alternate embodiment of the present invention, alternate numbers of electrically conductive pathways or wires can be provided within this coupling device for example, two, three, four or more pathways. In one embodiment, two electrically conductive pathways are provided, wherein these electrically conductive pathways are assigned voltage and ground, respectively, wherein data transfer along one of these electrically conductive pathways can be enabled using a CAN high signal and a CAN low signal.

The connections between the multiple components of the coupling device, the housing and the foot panel can be provided by one or more different securing means, wherein the securing means can be screws, bolts, rivets, or other securing means as would be readily understood by a worker skilled in the art. In one embodiment of the present invention, the securing means defining rotational axes can be configured with an integrated bearing system. For example, the securing system can be a bolt with a covering sheath that is movable around the bolt. For example this configuration can have a plurality of bearings positioned in the region defined by the interior of the sheath and the bolt, thereby enabling relative movement therebetween.

Control Module

The control module is operatively coupled to the patient support apparatus and can provide a means for controlling the plurality of patient support apparatus functions. In one embodiment of the present invention, the control module can control the basic patient support apparatus movements such as changing the height of the patient support apparatus or to move the head, thigh or foot portions of the patient support apparatus or the overall height of the patient support apparatus.

The control module is a computing device having a central processing unit (CPU) and peripheral input/output devices to monitor parameters from peripheral devices that are operatively coupled to the control module. These input/output devices can also permit the CPU to communicate and control peripheral devices that are operatively coupled to the control module. The control module comprises one or more storage media collectively referred to herein as "memory". The memory can be volatile and non-volatile computer memory such as RAM, PROM, EPROM, and EEPROM, floppy disks, compact disks, optical disks, magnetic tape, or the like, wherein control programs (such as software, microcode or firmware) for monitoring or controlling the devices coupled to the control module are stored and executed by the CPU. The control module also provides the means of converting user-specified operating conditions into control signals to control the peripheral devices coupled to the control module. The control module can receive user-specified commands by way of a user interface, for example, a keyboard, a touchpad, a touch screen, a console, a visual or acoustic input device as is well known to those skilled in this art. The control module further comprises an interface for a communication network, which can be configured as a wired or wireless network.

In one embodiment of the present invention, the control module can control the more advanced treatment functions such as, without limitations, the Trendelenburg position, various chair positions, the CPR position, the breaking, the scale functions, the patient support apparatus exit related functions, the various mattress functions, the wheel position for moving the patient support apparatus as well as the motorised wheel. In addition, if required the control module can be configured to control different types of mattresses that can be coupled thereto. For example, when a mattress is connected, the control module detects its type and displays the corresponding contextual menu.

Figure 28:
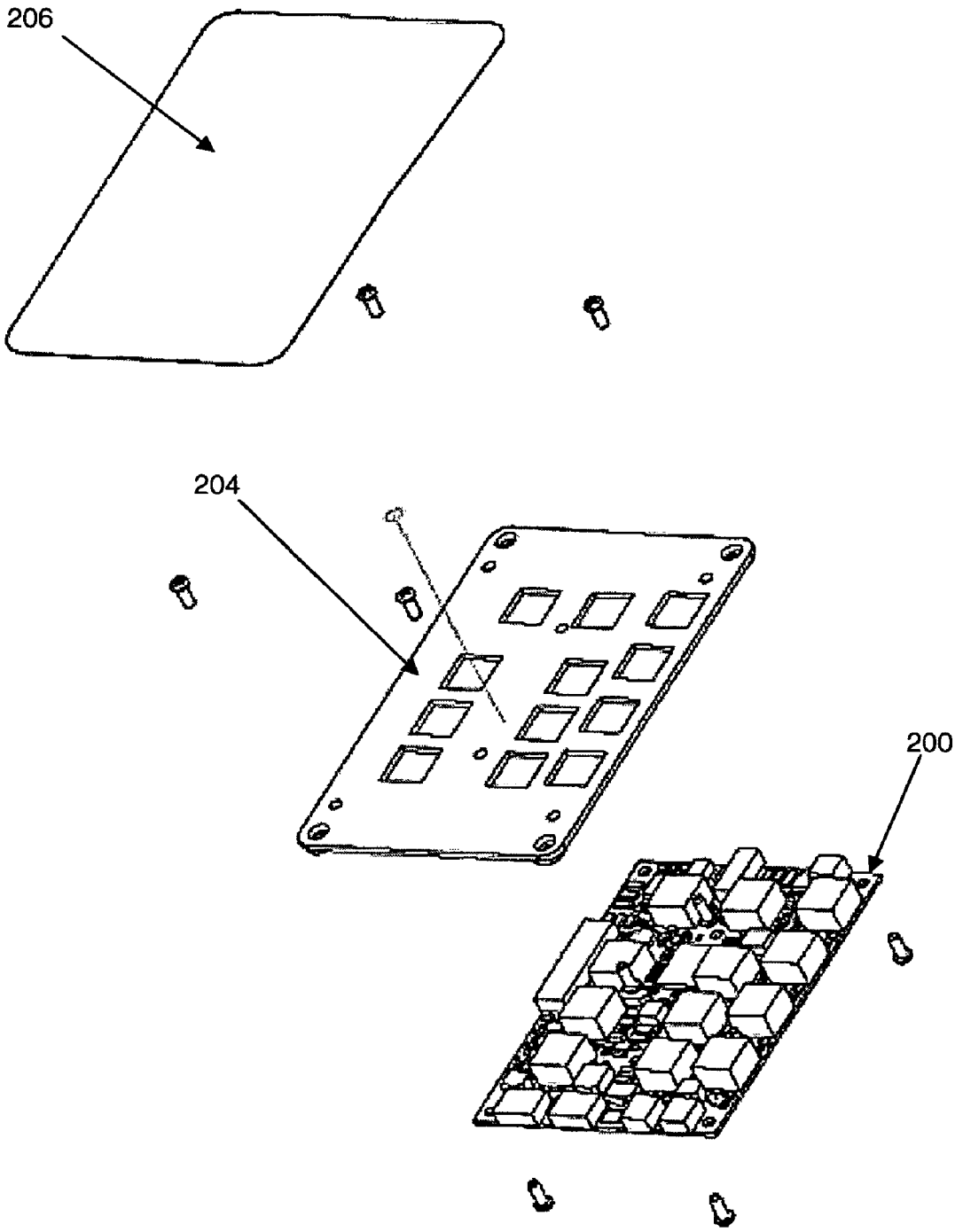
FIG. 28 is an exploded view of a control module according to one embodiment of the present invention.

In one embodiment of the present invention, and as illustrated in FIG. 28, the control module comprises one or more circuit boards 200, which include a series of buttons, switches, electronics and other means necessary to allow the control module to control operation of the features of the patient support apparatus. A structural support 204 can provide support to the plurality of buttons and/or switches and provide a degree of protection to the one or more circuit boards to which it is connected. In one embodiment, the structural support can be fabricated from a transparent or translucent material thereby enabling light to diffuse substantially uniformly on the whole surface underneath. A protective membrane 206 can be positioned overtop of the structural support and can provide indications of the operational characteristics of the various components associated with the circuit boards, for example the buttons and switches. In one embodiment, the a form of retro lighting can be provided, wherein this lighting can be provided by fibre optics located directly underneath the protective membrane and may illuminate the structural support. The lighting may also be provided through diodes or other lighting devices as would be readily understood.

Access Security

In one embodiment of the present invention, the control module comprises a digital biometric recognition system. For example, a person wishing to use the control module would then have to apply at least one of his or her fingers to the digital biometric recognition system to be positively identified as a pre-authorized individual such as a health care provider for example. Such a system is an enhanced security feature that can ensure that only the pre-authorized individuals will be able to use the control module and gain access to its various functions and data stored thereon or the network to which it is linked.

Proximity Sensor

In one embodiment of the invention, the control module comprises a proximity sensor. The health care provider or the operator activates this proximity sensor by approaching it within a predetermined distance, thereby enabling access to the control module. This function prevents visitors or other personnel from activating functions. There is a predetermined delay time for the proximity sensor to be activated or deactivated and this form of functionality can eliminate false activation of the proximity sensor if the health care provider or the operator is only passing by the patient support apparatus. In one embodiment of the invention where the control module comprises a proximity sensor configured as a passive or an active RFID (Radio Frequency Identification). A reader, located within the patient support apparatus, which will therefore determine whether the health care personnel are approaching the patient support apparatus or not and have this piece of information sent to the control module.

Data Transfer and Communications

In one embodiment of the present invention, all the wires needed to establish a connection between the control module and the patient support apparatus are designed to go through the coupling device used for the mechanical connection. Accordingly, all the said wires are internal and not visible from the exterior of the control apparatus, thereby eliminating the risk of entanglement between the wires and other parts of the control apparatus or of the patient support apparatus. Such a design further eliminates encumbrances from external wires for the health care provider to attend to the patient properly and efficiently. In another embodiment of the present invention, the operative coupling between the control module and the patient support apparatus can be provided by a external wire system, or can be provided in a wireless manner.

In one embodiment of the present invention, the control module is linked to a patient support apparatus network, which can be of any kind known in the art such as serial communication networks, CAN-based networks, Echelon™-based networks, peer-to-peer networks, etc. These types of networks do not represent limitations, as any type of known communication network can be used without departing from the present invention. The control module can also be wireless, based on various types of wireless communications networks such as, without limitations, RF (Radio Frequency field propagation) communications, Bluetooth® communications, Infra-red communications and ultrasound communications, IEEE 802.11 protocol based communications.

In one embodiment of the present invention, the communication network is an embedded communication network, which uses Controller Area Network (CAN) technology to facilitate communication in the form of a broadcast message (i.e. every message is sent to all the modules coupled to the network). Every message sent has a unique message ID. In this network, a general acknowledge message is sent by all the modules coupled to the network which receive the message correctly without any errors. All acknowledge messages are sent to all the modules, simultaneously. Based on the unique message ID of the original message, the control module associated with the specific task requested in the original message reacts by completing the task. Determination of which message IDs are used by which control module is not part of the CAN specification and is usually determined by the application. In this embodiment of the communication network an error message for failure of delivery will only be generated if none of the control modules properly receives the message because if one control module receives the original message, an acknowledge message will be sent.

Figure 29:
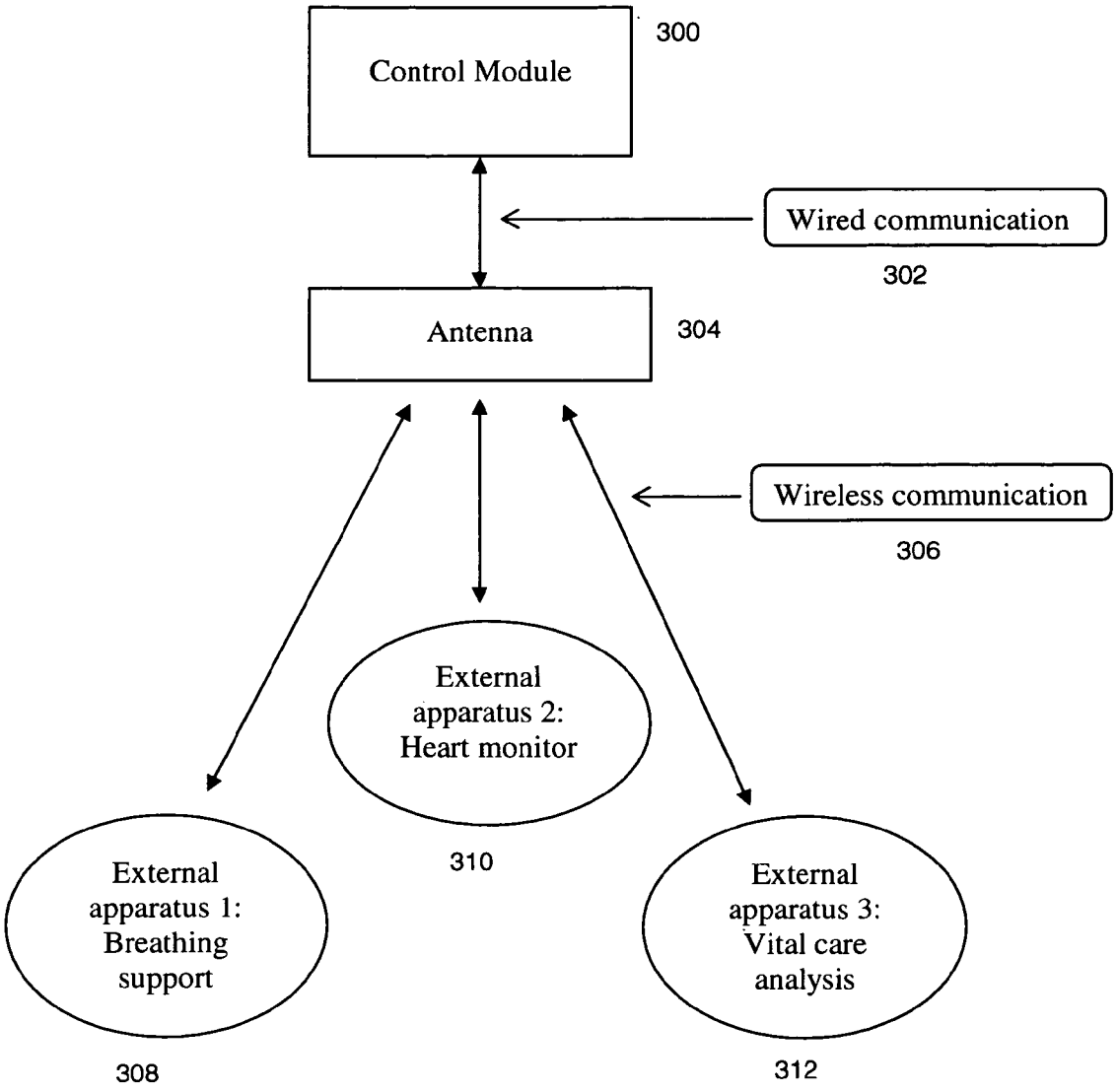
FIG. 29 illustrates connectivity between the control module and external apparatuses, according to one embodiment of the present invention.
Figure 30:
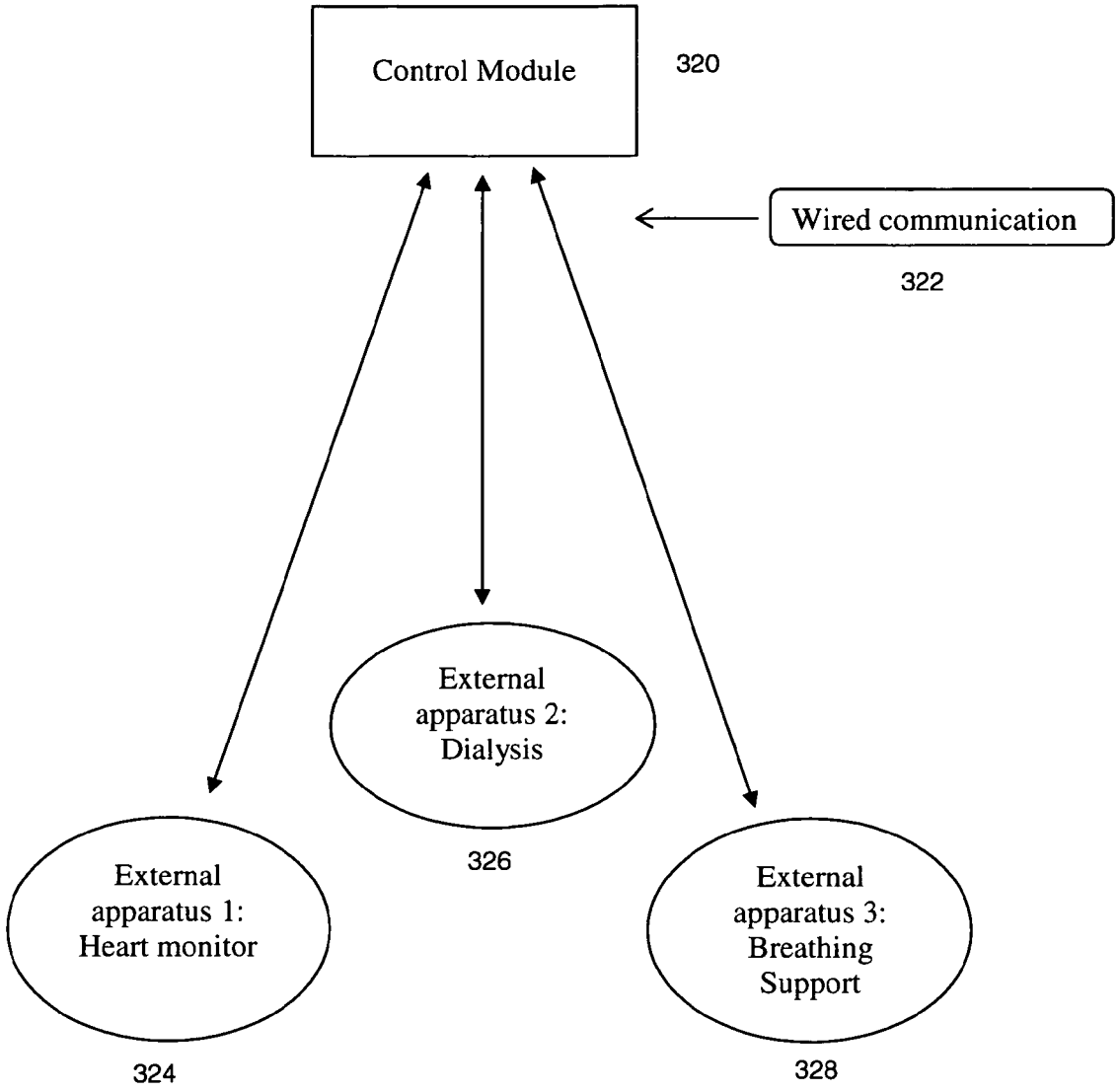
FIG. 30 illustrates connectivity between the control module and one or more external apparatuses, according to another embodiment of the present invention.

In one embodiment of the present invention and as illustrated in FIGS. 29 and 30, the control module can communicate with apparatuses other than the patient support apparatus. For example as illustrated in FIG. 29, the control module 300 can communicate to an antenna 304 via wired communication 302, wherein the antenna can enable the control module to communicate with and control functions of the other apparatuses through wireless communication 306, wherein the other apparatuses can be for example, breathing support 308, heart monitor 310 and vital care analysis 312. Alternately, for example as illustrated in FIG. 30, the control module 320 can communicate with and control functions of the other apparatuses through wired communication 322, wherein the other apparatuses can be for example, heart monitor 324, dialysis 326 and breathing support 328.

Figure 31:
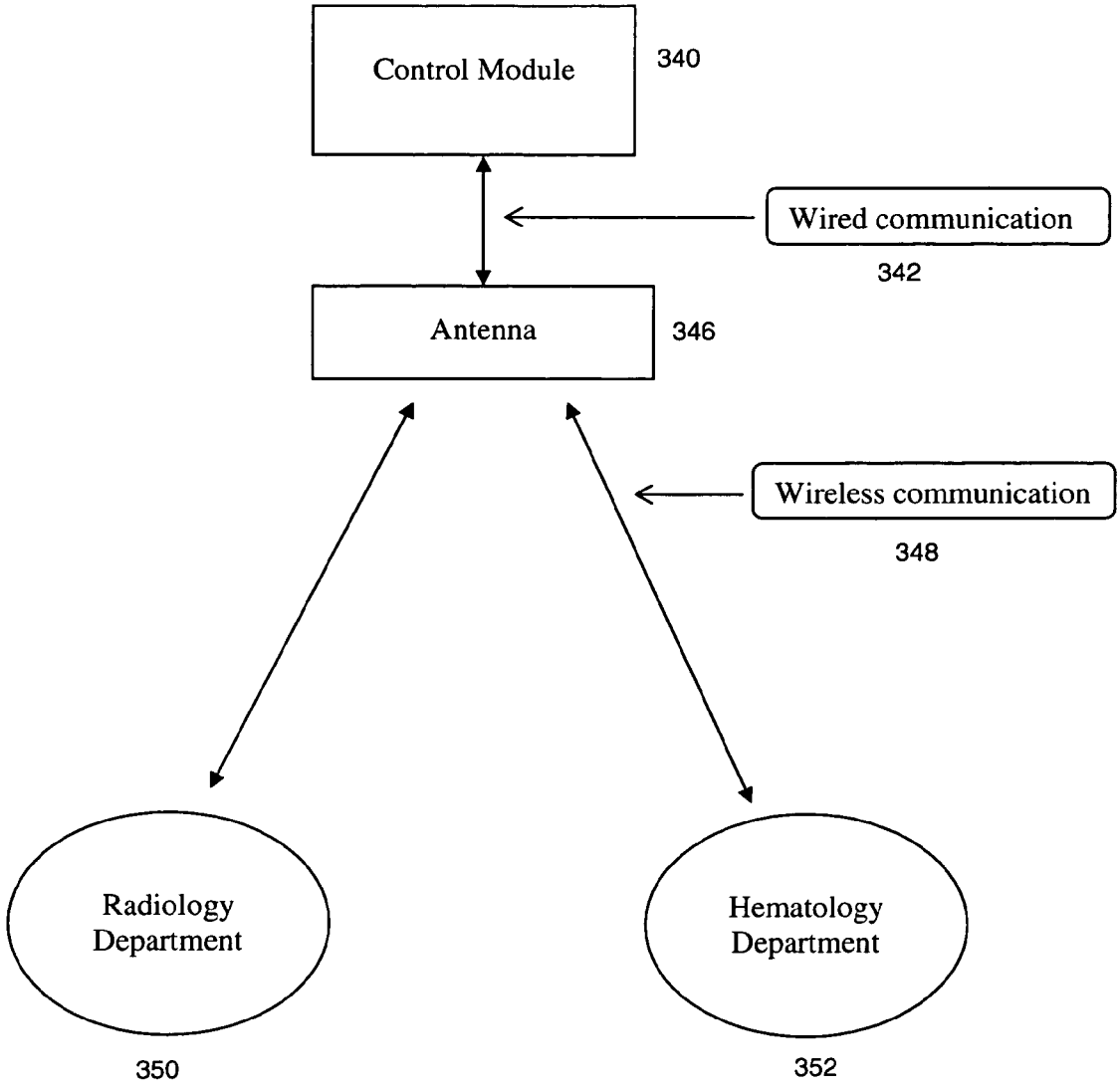
FIG. 31 illustrates connectivity between the control module and one or more departments within an establishment, according to one embodiment of the present invention.
Figure 32:
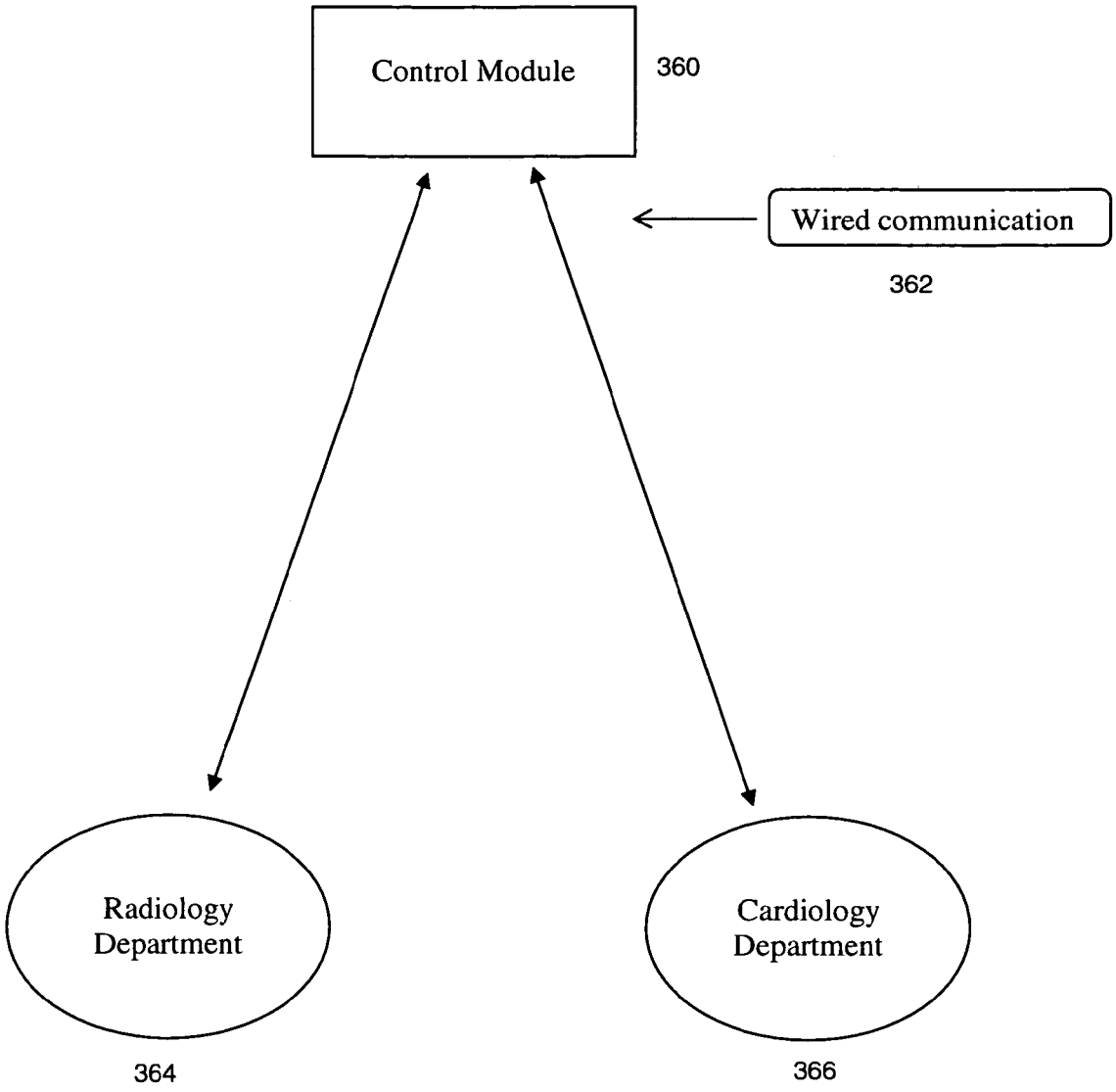
FIG. 32 illustrates connectivity between the control module and one or more departments within an establishment, according to another embodiment of the present invention.

In one embodiment of the present invention and as illustrated in FIGS. 31 and 32, the control module can communicate with departments within the hospital. For example as illustrated in FIG. 31, the control module 340 can communicate to an antenna 342 via wired communication 346, wherein the antenna can enable the control module to communicate with and other departments through wireless communication 342, wherein the departments can be for example, radiology 350 and hematology 352. Alternately, for example as illustrated in FIG. 32, the control module 360 can communicate with department within the hospital through wired communication 362, wherein the departments can be for example, radiology 364 and cardiology 366.

Power Supply

The power for the control module can be provided by the patient support apparatus or from another power source. If it is provided by the patient support apparatus, it can be from an alternating current or direct current. If it comes from outside of the patient support apparatus, it can come from another medical apparatus having an auxiliary outlet or a battery pack (conventional or rechargeable), or directly from a power source such as a power outlet. The power source can also be a photoelectric cell to keep the memory and the processors' power or a high or low frequency radiation energy. A further possible source of power for the control module is through an electromechanical setting that will enable any mechanical motion to be used to generate current (electricity) that will, in turn, be used to recharge a battery which could be used to drive the module. The electromechanical setting can be as simple as a coil with a magnet or as complex as Piezo™ sensors (generators) which convert mechanical energy into electrical energy. Depending on the other source(s) used to power a particular patient support apparatus, simpler AC (alternating current) electromechanical generators, known as alternators, or DC electromechanical generators can be used.

Touch Screen

In one aspect of the invention, the control module comprises a touch screen. The touch screen can have colours and can comprise contextual menus to facilitate the learning and use of the control module. The touch screen will display the menus in an upright fashion so that a person standing or sitting by the patient support apparatus could easily read them. The touch screen can have various specialised menus for achieving different uses of the control module. The following are examples of screen displays and menus which could be used on the touch screen according to embodiments of the present invention.

A "Motion Screen Display" can show the representation of the mattress support, monitoring the respective angle of the different segments of the mattress support by subtracting their relative angle from the angle of the Trendelenburg. The numerical angles shown in the display indicate the real angle with respect to the horizontal plane. An icon representing the height of the patient support apparatus can follow the current height of the patient support apparatus by changing the colours of the segments which indicate the height itself. An icon for the Trendelenburg angle can indicate the sign of the Trendelenburg and the angle of the Trendelenburg. The buttons can change colour when they are pressed. When the limit of motion is reached, the buttons can be altered, for example can become shaded, to indicate that the limit is reached and thus, no further motion is possible. A "Lockout Display Screen" can allow the user to view and change the lockout state of the patient support apparatus by applying different parameters for the structural elements of the patient support apparatus playing a role in any lockout states. A "Weighing Display Screen" can allow the user to view and monitor the weight and variations thereto of a patient by presenting the values being read by the weighing scale of the patient support apparatus. A "Chaperone Display Screen" can be used for various continuous monitoring purposes, for example to monitor the patient support apparatus exit occurrences and frequency of a patient. A "Configuration Screen Display" can be used to configure and calibrate the control module and it's related functions. The previous non exhaustive list of examples of screen displays and menus are provided for illustrative purposes to better understand the present invention. The actual screen displays and menus of the touch screen for a particular patient support apparatus will be determined by the functions of the patient support apparatus and the needs of the operator.

In order to provide a good and constant visibility and accessibility, the positioning of the touch screen is designed not to be affected by movements of the foot section of the patient support apparatus. The touch screen according to an embodiment of the present invention is able to maintain its initial position through a telescopic support maintaining the height of the control module at all times. Therefore, although the foot section will move to meet the needs of the patient or the health care provider, the touch screen will always be in a reasonable field of vision for the health care provider or the operator.

The touch screen according to an embodiment of the present invention is removable from its position on the patient support apparatus. It is therefore possible to use the touch screen as a tool to explain the data stored in the control module or simply to show it to the patient at times such as to explain the patient's health status.

In an embodiment of the present invention, the touch screen can also be equipped with one or more speakers to give instructions to the hospital staff. Hospital staff can use the touch screen to facilitate the study of the data. A summary of the patient status can be communicated by the touch screen. For example, the touch screen will have the possibility to provide a weight summary of the patient and provide, as the case may be, variations in the patient's weight throughout a predetermined period of time. The touch screen can also assist the hospital staff for specific tasks such as calibrating the patient support apparatus.

The control module of the control apparatus according to an embodiment of the invention can also have a secondary interface for the patient. As it is sensitive to gravity and it communicates with the patient support apparatus, the control module is aware of whether it faces the interior or exterior of the patient support apparatus. When the module faces the interior of the patient support apparatus, the touch screen can modify itself to display only the patient dedicated functions. The touch screen can also be used to entertain the patient by being used as a television, a gaming console or an internet communication device using the touch screen for a keyboard. The control module can detect its relative position and can adjust the orientation of the user interface in the proper orientation for a user to operate the control module.

In accordance with an aspect of the invention, the touch screen itself can have its own keyboard, similar to a laptop PC, or the screen can be completely turned in order to give a keyboard view. With a system akin to a laptop PC, the touch screen can also be used as a personal computer for some patients. As such, at the patient's request, the touch screen can simply be used as a laptop computer. This system will allow the use of the screen as a computer but without having access to the patient data without the key of the health care provider or other authorised personnel. Other than this, the touch screen will change mode automatically. The patient will then be able to browse the Internet, check his/her email and perform other tasks normally accomplished with the use of a laptop PC from this touch screen.

Add on Functionality

In another embodiment of the present invention, the control module can also comprise a camera and a speaker and a microphone. As these components can be oriented in all directions, they can provide a continuous visual and verbal communication between the patient and a health care provider. This configuration can also be used for communication from one health care provider to another, whether the latter is at a guard station, in another department, in front of another patient support apparatus with similar equipment or even outside the hospital where the control module is located.

In another embodiment of the invention, the control module transmits the location and the orientation of the patient support apparatus within the hospital. A compass in the patient support apparatus transmits the orientation to the control module and the antenna transmits the information to a data processing centre, for evaluation.

In an embodiment of the invention, the control module displays the patient support apparatus status. If the patient support apparatus is unoccupied, the module indicates if the patient support apparatus is ready to receive a patient or not. If it is not ready, the screen of the control module can display what needs to be done to prepare to receive the next patient. The control module can also display other information such as the brakes status or when the siderails are locked in a predetermined position, for example.

In a further embodiment of the present invention, the control module comprises a diagnostic menu to visualise the status of the patient support apparatus and its components as well as the status of the communication network linking it to the other accessories, apparatuses, departments or peripherals.

Information Handling

According to one embodiment of the present invention, the patient support apparatus has a CD and/or a DVD burner, which can be incorporated within the control module or physically separated therefrom. The patient support apparatus can also have communication systems such as USB, Bluetooth® or any communication systems known in the art that can be used with a computer and data storing apparatuses.

The control module can communicate with the health care provider directly. The health care provider can insert a flash memory key or a USB key in the patient support apparatus or in the control module to download the information from the patient's file and display it on a screen. Any type of physical or electronic key can be used for this purpose. By this process, security problems associated with wireless data transmission in the hospital may be eliminated. The health care provider can enter data in the patient file by entering the data directly on the control module and it will be loaded on the flash memory key as long as it is connected to the patient support apparatus. The health care provider can then transmit this data by connecting the memory key in the appropriate slot at the guard station, for example. This slot communicates with the various relevant departments in the hospital and can adjust the patient's file accordingly. Information such as the date, time, and identification of the health care provider are automatically included in the patient's file for a complete follow-up. The memory key contains all the relevant information regarding the patients under the health care provider's care in one department. The information on the memory key is updated each time it is inserted in the designated slot at the guard station. If a health care provider works in several departments of an establishment, he or she must connect the memory key to each guard station of each department. For security purposes of the individual information, the data can be encrypted and the encryption codes are only known by the establishment. This information can be transmitted from one establishment to another by known methods of encrypted communication. The patient data could nevertheless be accessed directly on the network without the need for a key.

In another embodiment of the invention, the control module communicates with the health care provider by wireless communication. As for the memory key, the same methods as previously described are used with the exception that the health care provider does not have to connect any apparatus to update the patient's file on the patient support apparatus and at the guard post. The wireless communication (Bluetooth® or other type) with an apparatus worn by the health care provider facilitates the data transport.

The control module also has a slot to insert disks which can contain relevant data about the patient's health or other information about the patient. The inserted disks will allow the download of data onto a disk in the control module, which in turn will display the various patient data without requiring the hospital staff to physically obtain the patient's file every time access to the data is needed. In order to protect the privacy of the patient, all the data is protected by a password or a key (for example USB, magnetic card or a card with a microchip) for which access is provided to select hospital staff. The touch screen is also equipped with a superior security system. Accordingly, the manipulation of the data, or of the patient support apparatus itself, is only possible with a key in the possession of hospital staff. This will ensure that visitors or others are prevented from changing the position of the patient support apparatus, accessing the functions of the patient support apparatus or the patient's private or confidential information that could be stored in the control module. The security system further allows identification, on a screen, of the individual who is controlling the patient support apparatus and also allows the user to keep a history of the changes relating to the patient. Such a system therefore allows for better tracking of the patient, its status and its progress.

In an aspect of the invention, the control module has a voice recognition system. Commands such as raising the patient support apparatus and the display of the weight variations for the patient are dictated by the hospital staff without having to select various menus for example via a touch screen associated with the control module, to make changes to the patient support apparatus or to access data from the control module.

In accordance with an aspect of the invention, the touch screen can also be equipped with technology allowing the hospital staff to take notes about the patient. Comments and notes could then be added via the touch screen. For example, the touch screen has laptop PC technology. It has handwriting recognition and is able to be used as a note book. The notes entered can be downloaded on a disk inserted in the disk reader provided. This allows to displaying the various comments added to the patient's file as well as the various medications or treatments administered to the patient. Therefore, information regarding the administered medication and treatments can be better controlled for the hospital staff.

While being connected to the hospital's network, the hospital staff can also browse on the network to access information stored on the network to determine, for example, the availability of doctors and the calendar of other personnel, therefore improving the services to the patients being treated. It is also possible to connect a keyboard to the screen through the USB, serial port or other port of the screen itself, or through wireless technology. The data can then be inputted via a keyboard that the hospital staff will have in their possession, if desired.

It is obvious that the foregoing embodiments of the invention are exemplary and can be varied in many ways. Such present or future variations are not to be regarded as a departure from the spirit and scope of the invention, and all such modifications as would be obvious to one skilled in the art are intended to be included within the scope of the following claims.

The disclosure of all patents, publications, including published patent applications, and database entries referenced in this specification are specifically incorporated by reference in their entirety to the same extent as if each such individual patent, publication, and database entry were specifically and individually indicated to be incorporated by reference.

We claim:

1. A patient support apparatus comprising:

a patient support surface;

a barrier extending around said patient support surface, said barrier including a headboard and a footboard; and a control apparatus comprising:

a) a housing, said housing being pivotally mounted in said barrier for pivoting between a stored position and a plurality of extended positions, including a fully extended position, and forming part of said barrier when in said stored position;

b) a control module adapted for connection to the housing, said control module operatively coupled to the patient support apparatus and configured for controlling one or more functions associated with the patient support apparatus; and c) a coupling device pivotally mounting the housing in said barrier, said coupling device providing pivotal movement of the housing about horizontal and vertical axes about a single pivot structure while at least a portion of said housing is in said barrier wherein the control apparatus can be positioned in a plurality of orientations about said axes in said barrier.

2. The patient support apparatus according to claim 1, wherein the control apparatus is mounted in said footboard.

3. The patient support apparatus according to claim 1, wherein the coupling device comprises a damping mechanism configured to limit speed of the movement of the housing.

4. The patient support apparatus according to claim 3, wherein the damping mechanism is configured as a mechanical mechanism, an electrical system, a hydraulic system or a magnetic system.

5. The patient support apparatus according to claim 1, wherein the coupling device is configured to provide electrical connectivity between the control module and the patient support apparatus.

6. The patient support apparatus according to claim 1, wherein the control module is operatively coupled to the patient support apparatus by a wireless communication network.

7. The patient support apparatus according to claim 1, wherein the control module is operatively coupled to the patient support apparatus by a wired communication network.

8. The patient support apparatus according to claim 1, wherein the coupling device comprises one of a ball and socket type connection and a multi-rotational joint connection.

9. The patient support apparatus according to claim 1, further comprising a user interface associated with said control apparatus, wherein said user interface is concealed when said housing is in said stored position, and said user interface being visible and accessible when said housing is moved to one of said extended positions.

10. The patient support apparatus according to claim 1, wherein the coupling device comprises three rotational joints, wherein each rotational joint includes two mating components.

11. The patient support apparatus according to claim 10, wherein the mating components are configured to provide electrical connectivity therebetween.

12. The patient support apparatus according to claim 1, wherein the control module comprises a proximity sensor configured to detect an authorized user's presence.

13. The patient support apparatus according to claim 1, wherein the control module comprises a biometric recognition system configured to authorize access to the control module upon verification.

14. The patient support apparatus according to claim 1, wherein the control module is operatively coupled to the patient support apparatus by a serial communication network, wherein the serial communication network is selected from the group comprising a controller area network, an Echelon network and a peer-to-peer network.

15. The patient support apparatus according to claim 1, further comprising a user interface associated with said control apparatus wherein the user interface is a touch screen interface.

16. The patient support apparatus according to claim 1, said barrier including an outer perimeter and a recess extending into said barrier from said outer perimeter, said housing mounted in said recess by said coupling device, and said housing forming a portion of said outer perimeter at said recess when said housing is moved to said stored position.

17. A patient support apparatus comprising:

a patient support surface;

a barrier extending around said patient support surface, said barrier including a headboard and a footboard; and a control apparatus comprising:

a) a housing, said housing being configured to form part of said barrier;

b) a control module adapted for connection to the housing, said control module operatively coupled to the patient support apparatus and configured for controlling one or more functions associated with the patient support apparatus; and c) a coupling device movably mounting the housing to the patient support apparatus, said coupling device providing movement of the housing in one or more directions relative to said patient support apparatus, said coupling device comprising three rotational joints, each rotational joint including two mating components, said mating components being configured to provide electrical connectivity therebetween, wherein a first of the two mating components comprises two or more electrically conductive pins and a second of the two mating components comprises two or more electrically conductive grooves, each electrically conductive groove configured to electrically and matingly connect with a particular electrically conductive pin.

18. The patient support apparatus according to claim 17, wherein the first of the two mating components comprises six electrically conductive pins and the second of the two mating components comprises six electrically conductive grooves.

* * * * *